US010766276B2

(12) United States Patent
Matsunaga

(10) Patent No.: US 10,766,276 B2
(45) Date of Patent: Sep. 8, 2020

(54) INK JET PRINTING APPARATUS

(71) Applicant: RISO KAGAKU CORPORATION, Tokyo (JP)

(72) Inventor: Katsuhiko Matsunaga, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/359,635

(22) Filed: Mar. 20, 2019

(65) Prior Publication Data

US 2019/0299660 A1 Oct. 3, 2019

(30) Foreign Application Priority Data

Mar. 30, 2018 (JP) ..... 2018-069203
Jun. 29, 2018 (JP) ..... 2018-123917

(51) Int. Cl.
*B41J 11/00* (2006.01)
*B41J 29/377* (2006.01)
*B41J 29/38* (2006.01)

(52) U.S. Cl.
CPC ..... *B41J 11/002* (2013.01); *B41J 29/377* (2013.01); *B41J 29/38* (2013.01)

(58) Field of Classification Search
CPC ..... B41J 11/002; B41J 29/377; B41J 29/38; B41J 29/13; B41J 11/06; B41J 3/28
USPC ..... 347/102
See application file for complete search history.

(56) References Cited

U.S. PATENT DOCUMENTS

2007/0126832 A1* 6/2007 Kito ..... B41J 11/06 347/101
2014/0267523 A1* 9/2014 Herrmann ..... B41J 11/0085 347/104
2016/0167403 A1* 6/2016 Toya ..... F26B 13/183 347/102
2018/0345686 A1* 12/2018 De Roeck ..... B41J 3/407

FOREIGN PATENT DOCUMENTS

JP 7-25007 1/1995
JP 10-217572 8/1998

* cited by examiner

*Primary Examiner* — Huan H Tran
*Assistant Examiner* — Alexander D Shenderov
(74) *Attorney, Agent, or Firm* — Greenblum & Bernstein, P.L.C.

(57) ABSTRACT

An inkjet printing apparatus that performs printing by ejecting ink from an ink jet head onto a print medium includes a drying unit for drying a liquid which is contained in the print medium, a table on which the print medium is placed; and a gas flow generating unit for generating a gas flow in a space which is formed between the table and a surface of the print medium toward the side of the table.

12 Claims, 15 Drawing Sheets

INK JET PRINTING APPARATUS

CROSS-REFERENCE TO RELATED APPLICATIONS

The present application claims priority under 35 U.S.C. § 119 to Japanese Patent Application No. 2018-69203, filed on Mar. 30, 2018 and Japanese Patent Application No. 2018-123917, filed on Jun. 29, 2018. The above applications are hereby expressly incorporated by reference, in its entirety, into the present application.

BACKGROUND OF THE INVENTION

1. Field of the Invention

The present invention is related to an inkjet printing apparatus having an inkjet heat that ejects ink.

2. Description of the Related Art

Conventionally, inkjet printing apparatuses that perform printing by ejecting ink from an inkjet head to a print medium such as paper and film have been proposed. In addition, printing processes are also being administered to building materials, decorative panels, etc. using such an inkjet printing apparatus.

SUMMARY OF THE INVENTION

Here, in the case that a building material formed by an aluminum series sintered material (hereinafter, simply referred to as "aluminum sintered material") is employed as a print medium, the aluminum sintered material is coated to a preliminary processing fluid in a preliminary process, the preliminary processing fluid is dried, and then a printing process is administered.

However, in the case that an aluminum sintered material which s coated with, for example, a preliminary processing fluid, is placed directly on a table of an inkjet printing apparatus and the aluminum sintered material is heated from above and dried, it is possible to evaporate the preliminary processing fluid which is contained in a porous material in the vicinity of the surface of the aluminum sintered material. However, the drying efficiency is low with respect to the preliminary processing fluid contained in the porous material in the interior of the aluminum sintered material and in the vicinity of the back side, that is, the side toward the table of the inkjet printing apparatus. This is because water vapor, which is generated by heating, is trapped by the table and cannot escape. The low drying efficiency results in a problem of decreased productivity. In addition, water droplets adhere on the side of the table. Therefore, the aluminum sintered material will be in close contact with the table, and there are problems that handling properties deteriorate and that the surface of the back side of the aluminum sintered body will become soiled.

Japanese Unexamined Patent Publication No. H10-217572 proposes to employ a mesh member as a platen when heating a printed sheet from the back side thereof on a platen. However, if only a mesh member is used, water vapor will still remain on the surface of the substrate after drying. As a result, drying speed decreases and it becomes difficult for the printed sheet to dry. In addition, when printing on a large sized substrate with the same apparatus, flatness cannot be secured, and therefore image quality will deteriorate.

In addition, Japanese Unexamined Patent Publication No. H7-25007 proposes to provide a print medium on a support portion having an opening through which water vapor is capable of passing, and to provide a condensation inducing portion for condensation of water vapor that has passed through the opening, when drying the print medium. However, a mechanism for processing the condensed liquid is necessary, and this configuration is not sufficient to dry a porous material such as the aluminum sintered material described above in a short amount of time.

The present invention has been developed in view of the foregoing circumstances. It is an object of the present invention to provide an inkjet printing apparatus, which is capable of improving the drying efficiency of a print medium when drying a liquid such as preliminary processing fluid An inkjet printing apparatus of the present invention is an inkjet printing apparatus that ejects ink from an inkjet head to a print medium to perform printing, comprising a drying unit for drying a liquid which is contained in the print medium, a table on which the print medium is placed, and a gas flow generating unit for generating a gas flow in a space which is formed between the table and a surface of the print medium toward the side of the table.

According to the inkjet printing apparatus of the present invention, in the case that a liquid which is contained in a print medium is to be dried, a space is formed between the table and the surface of the print medium toward the side of the table, and gas flow is generated in the formed space by the gas flow generating unit. Therefore, the drying efficiency of the print medium can be improved, and as a result, productivity can be improved.

DETAILED DESCRIPTION OF THE EMBODIMENTS

Figure 1:
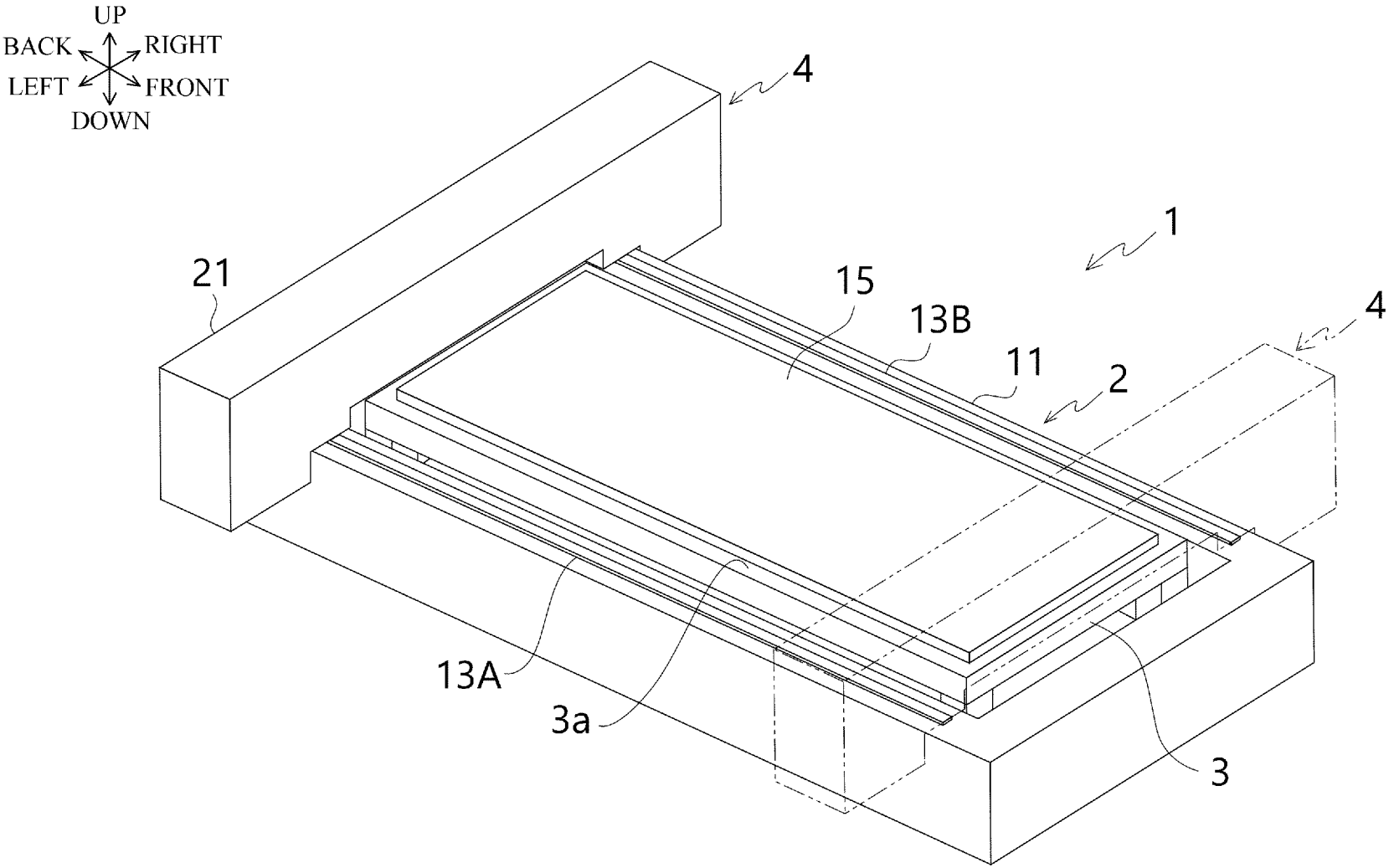
FIG. 1 is a perspective view that illustrates the schematic configuration of an inkjet apparatus according to a first embodiment.

Hereinafter, a first embodiment of an inkjet printing apparatus of the present invention will be described in detail with reference to the drawings. FIG. 1 is a schematic diagram that illustrates the configuration of an inkjet printing apparatus 1 of the present embodiment. Note that FIG. 1 is a diagram that illustrates a state in which a support member 40 to be described later is accommodated in a flat bed unit 3. In addition, in the description of the embodiments described below, the up, down, left, right, front, and back directions indicated by arrows in FIG. 1 are defined as the up, down, left, right, front, and back directions of the inkjet printing apparatus 1.

As illustrated in FIG. 1, the inkjet printing apparatus 1 of the present embodiments equipped with a shuttle base unit 2, the flat bed unit 3, a shuttle unit 4, a drying unit 50, a preliminary processing unit 6, and a gas flow generating unit 60.

A shuttle base unit 2 supports the shuttle unit 4, the drying unit 50, and the preliminary processing unit 6, and moves the shuttle unit 4, the drying unit 50, and the preliminary processing unit 6 in the front-back direction (sub scanning direction). Specifically, the shuttle base unit 2 is equipped with a mount portion 11 and a sub scanning drive motor 12 (refer to FIG. 6).

The mount portion 11 is formed in the shape of a rectangular frame, and supports the shuttle unit 4, the drying unit 50, and the preliminary processing unit 6. Sub scanning drive guides 13A and 13B that extend in the front-back directions are respectively formed on the left and right sides of the mount portion 11. The sub scanning drive guides 13A and 13B guide the shuttle unit 4, the drying unit 50, and the preliminary processing unit 6 such that these elements move in the front-back directions.

The flat bed unit 3 supports a print medium 15, which is the aforementioned building material or decorative panel formed by a porous material. Note that an aluminum sintered material is an example of the building material formed by a porous material. An aluminum sintered material is formed by molding aluminum powder into the shape of a plate by sintering. However, the print medium 15 having the porous material is not limited to an aluminum sintered material, and other base materials may be employed. In addition, in the present embodiment, the flat bed unit 3 corresponds to the table of the present invention.

The flat bed unit 3 is provided within a rectangular parallelepiped shaped recess, which is formed in the interior of the mount portion 11 of the shuttle base unit 2. The flat bed unit 3 has a medium placement surface 3*a*, which is a horizontal surface on which the print medium 15 is placed. The flat bed unit 3 has a hydraulic driving mechanism or the like, which is omitted from the figure and is configured to adjust the height of the medium placement surface 3*a*.

In addition, the support member 40 to be described later is housed within the flat bed unit 3, and passage apertures 3*b*, through which the support member 40 passes when the support member 40 protrudes from the flat bed unit 3, are formed in the medium placement surface 3*a* of the flat bed unit 3. The passage apertures 3*b* are formed according to the shape of the support member 40. In the present embodiment, the passage apertures 3*b* are formed as rectangular shapes that extend in the front-back directions.

The support member 40 of the present embodiment is equipped with a plurality of lifting units 41, which are formed as rectangular parallelepipeds that extend in the horizontal direction. The plurality of lifting units 41 are provided such that the direction that they extend in is parallel to the direction of gas flow which is generated by the gas flow generating unit 60. During a printing operation, the plurality of lifting units 41 are housed within the flat bed unit 3, as illustrated in the upper portion of FIG. 2. Meanwhile, during a drying operation of the print medium 15 and during a gas flow generating operation to be described later, the lifting units 41 move upward as illustrated in the lower portion of FIG. 2, and protrude from the medium placement surface 3*a* of the flat bed unit 3. A support member elevating mechanism 30 that moves the lifting units 41 in the up-down direction (vertical direction) is provided within the flat bed unit 3. The support member elevating mechanism 30 has a predetermined actuator.

By causing the lifting units 41 to protrude from the medium placement surface 3*a* of the flat bed unit 3 with the support member elevating mechanism 30, a space can be formed between the print medium 15 which is placed on the lifting units 41 and the flat bed unit 3. The gas flow which is generated by the gas flow generating unit 60 can flow through the space.

Meanwhile, when conducting a printing operation, the support member elevating mechanism 30 moves the lifting units 41 downward, to house the lifting units 41 within the flat bed unit 3. Thereby, the print medium 15 can be directly placed on the medium placement surface 3*a* of the flat bed unit 3. Therefore, the flatness (horizontal property) of the print medium 15 can be secured, and the image quality of a printed image will be guaranteed.

Figure 2:
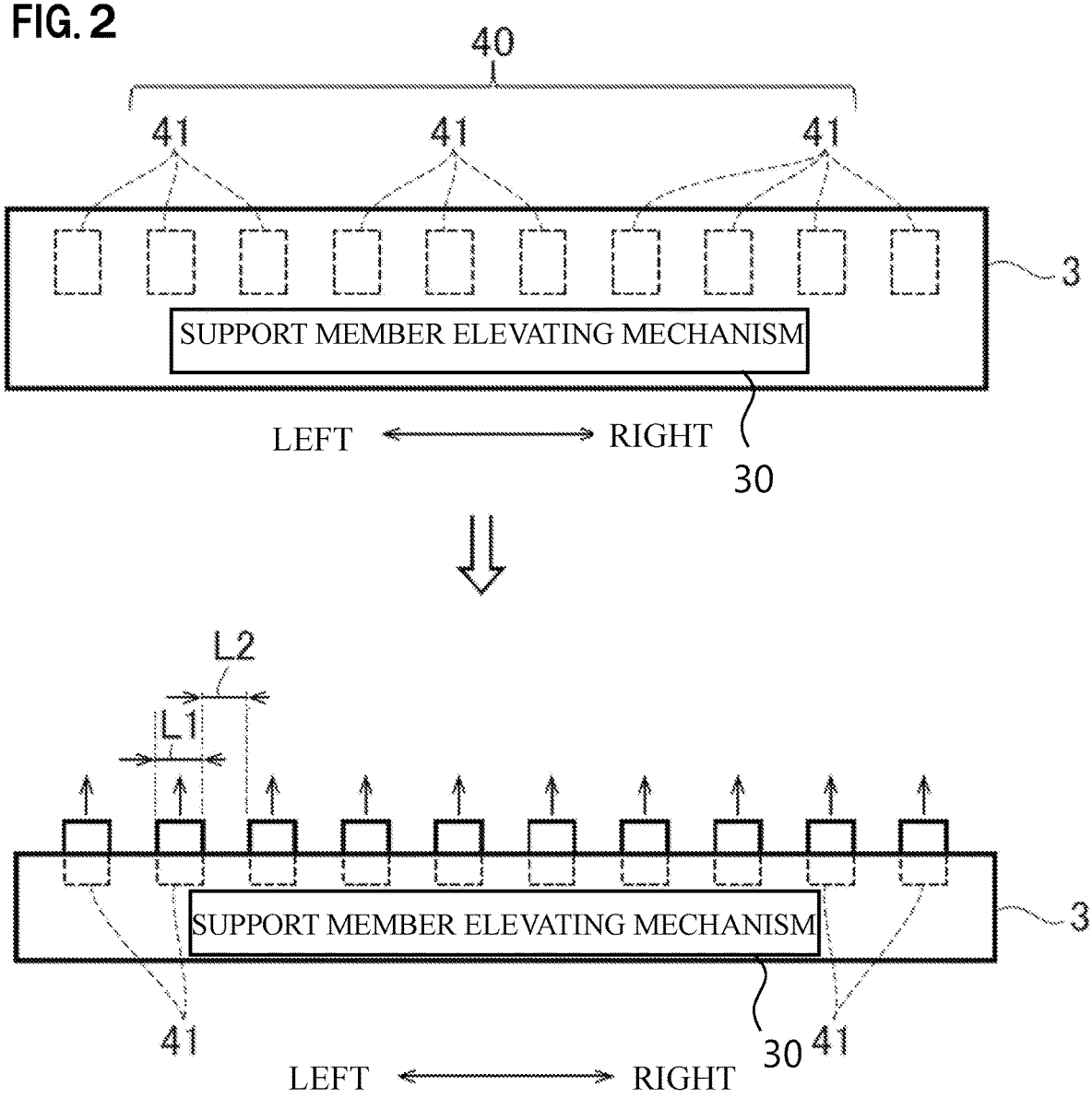
FIG. 2 is a collection of diagrams that illustrate an example of a support member constituted by a plurality of lifting units.

Regarding the relationship between the lifting units 41 and the spaces among the lifting units 41, the area of the portions where the lifting units 41 and the print medium 15 are in contact with each other is smaller than the area of the entire lower surface of the print medium 15, preferably ⅔ the area or less. It is more preferable for the area of the portions where the lifting units 41 and the print medium 15 are in contact with each other to be ½ or less than the area of the entire lower surface of the print medium 15, and still more preferably ⅓ or less. In the case of the support member 40 of the present embodiment, if the width in the direction orthogonal to the direction that the lifting units 41 extend is designated as L1, and the width in the direction perpendicular to the direction of the spaces among lifting units 41 is designated as L2. It is preferable for L1≤2×L2, more preferably L1≤L2, and still more preferably L1≤L2/2, as illustrated in FIG. 2.

Figure 3:
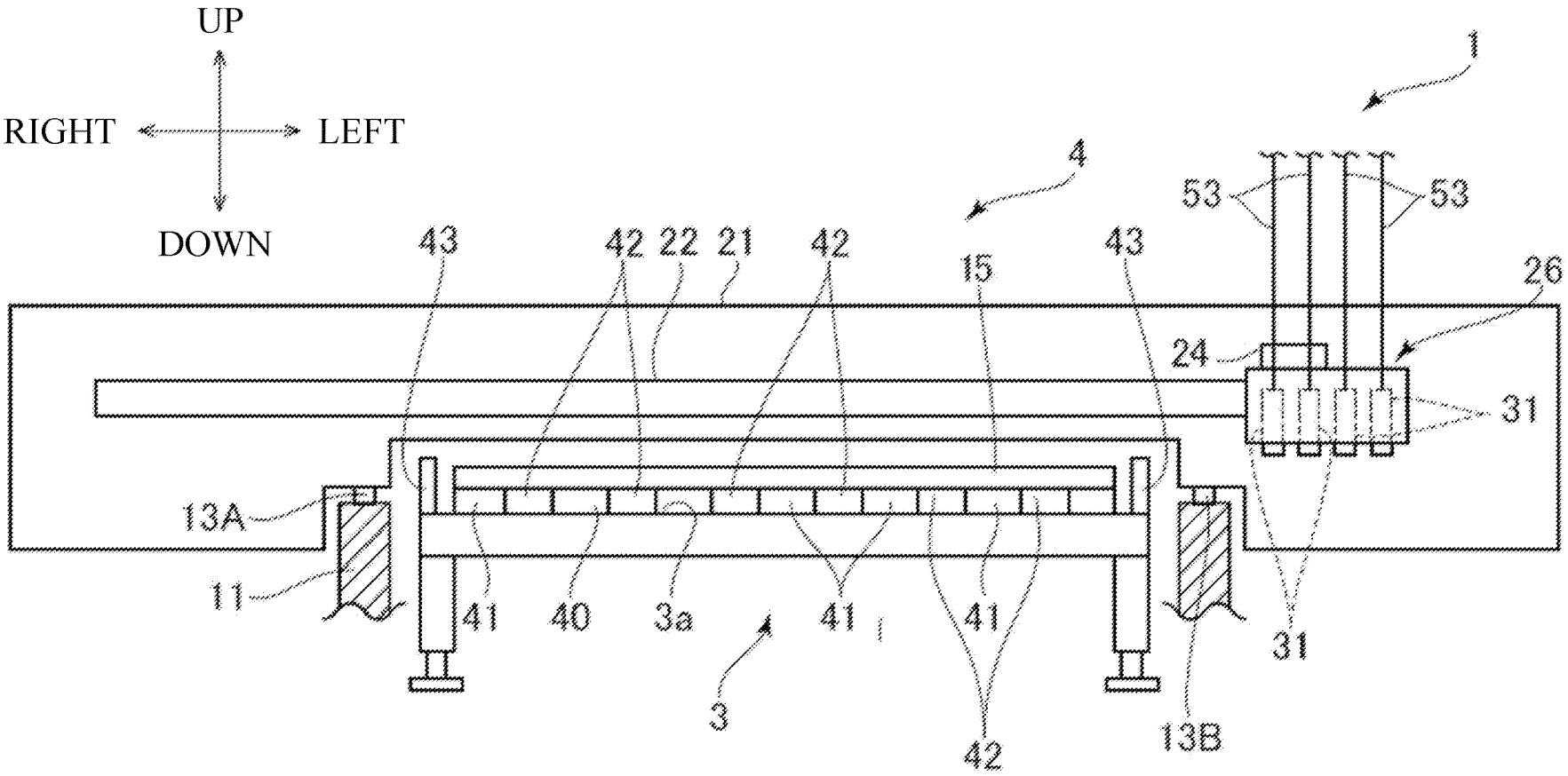
FIG. 3 is a diagram that illustrates the schematic configuration of a shuttle unit.

The shuttle unit 4 administers a printing process on the print medium 15. FIG. 3 is a diagram that illustrates the schematic configuration of the shuttle unit 4. Note that FIG. 3 illustrates a state in which a flow straightening member 43 to be described later is provided on the flat bed unit 3 and the print medium 15 is provided on the lifting units 41 of the support member 40.

As illustrated in FIG. 3, the shuttle unit 4 is equipped with a casing 21, a main scanning drive guide 22, a main scanning drive motor 23 (refer to FIG. 6), a head elevation guide 24, a head elevating motor 25 (refer to FIG. 6), and a head unit 26.

The casing 21 houses each of the above components, such as the head unit 26. The casing 21 is formed in the shape of a gate that straddles the flat bed unit 3 in the left-right direction. The casing 21 is supported by the mount portion 11 of the shuttle base unit 2 and is configured to be movable along the sub scanning drive guides 13A and 13B.

The main scanning drive guide 22 guides the head unit 26 such that it moves in the left-right direction (main scanning direction). The main scanning drive guide 22 is formed by an elongated member that extends in the left-right direction. The head unit 26 is moved in the left-right direction by the main scanning drive motor 23.

The head elevation guide 24 guides the head unit 26 such that it moves in the vertical direction. The head elevation guide 24 is formed by a member having an elongated shape in the vertical direction. The head elevation guide 24 is configured to be movable in the left-right direction along the main scanning drive guide 22 together with the head unit 26. The head unit 26 is moved up-down in the vertical direction by a head elevating motor 25.

As described above, the head unit 26 performs a print process by ejecting ink to the print medium 15 while moving in the left-right direction along the main scanning drive guide 22. The head unit 26 has four inkjet heads 31, as illustrated in FIG. 3.

Figure 4:
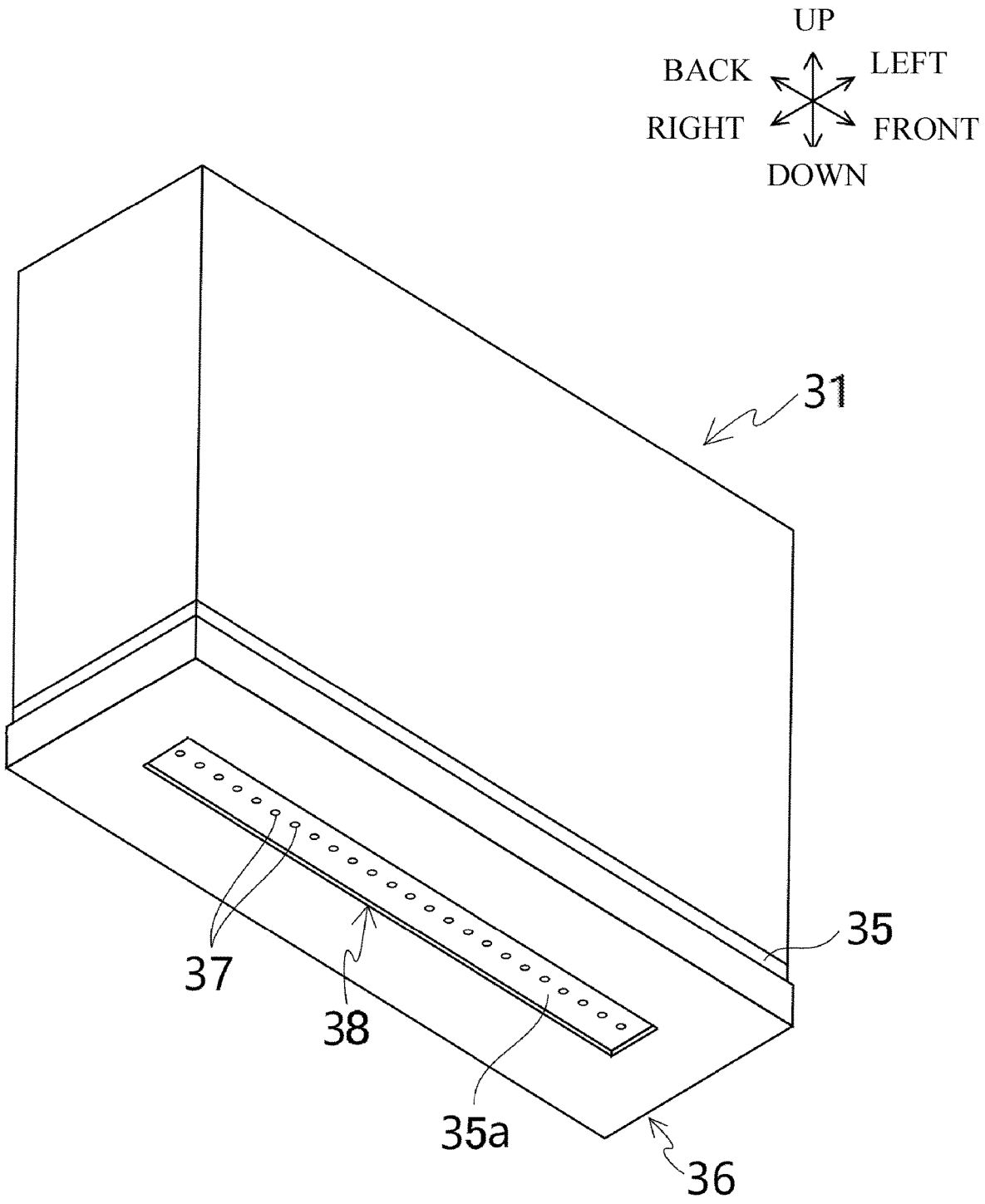
FIG. 4 is a perspective view that illustrates the outer appearance of an inkjet head.

FIG. 4 is a perspective view that illustrates the outer appearance of an inkjet head 31. As illustrated in FIG. 4, the inkjet head 31 has a nozzle plate 35 and a nozzle guard 36. The nozzle plate 35 has a nozzle row in which a plurality of nozzles 37 for ejecting ink are arranged in the front to rear direction.

The nozzle guard 36 protects an ink ejection surface 35*a* of the nozzle plate 35, has an opening 38 in a portion corresponding to the nozzle row of the nozzle plate 35. The nozzle guard 36 is provided on the ink ejection surface 35*a* of the nozzle row. The opening 38 of the nozzle guard 36 is formed in a rectangular shape which is elongated in the front to rear direction, and is formed such that all the nozzles 37 are exposed.

Four of the inkjet heads 31 are arranged in the left-right direction such that they are parallel to each other. The four inkjet heads 31 eject inks of different colors (cyan, black, magenta and yellow, for example).

Returning to FIG. 1, the preliminary processing unit 6 performs preliminary processing by applying a preliminary processing fluid to the print medium 15, which is formed by a porous material. In the present embodiment, the preliminary processing unit 6 is provided forward of the drying unit 50. Configurations for applying the preliminary processing fluid to the print medium 15 may be configurations similar to the head unit 26 and the main scanning guide 22 provided within the shuttle unit 4, to which preliminary processing fluid is supplied instead of ink. Such a configuration may eject the preliminary processing fluid onto the print medium 15. Alternatively, a configuration may be adopted, in which a brush or a blade on which the preliminary processing fluid is coated is moved in the left-right direction (main scanning direction) to coat the print medium 15 with the preliminary processing fluid.

The preliminary processing unit 6 is supported by the mount portion 11 of the shuttle base unit 2 and is configured to be movable along the sub scanning drive guides 13A and 13B. The preliminary processing unit 6 sequentially applies the preliminary processing fluid to a predetermined range on the print medium 15 underneath the preliminary processing unit 6 by moving in the sub scanning direction.

The drying unit 50 evaporates the liquid that is absorbed in the print medium 15, which is formed by a porous material (preliminary processing fluid and ink in the present embodiment). The drying unit 50, which is provided between the shuttle unit 4 and the preliminary processing unit 6 the present embodiment, is equipped with a heater that extends in the left-right direction (main scanning direction).

The drying unit 50 is supported by the mount portion 11 of the shuttle base unit 2 and is configured to be movable along the sub scanning drive guides 13A and 13B. The drying unit 50 sequentially heats areas underneath it by moving in the sub scanning direction, and sequentially evaporates the liquid which is contained within the print medium 15, to dry the print medium 15. The drying unit 50 may be that which has a fan and a heating means such as a heater or the like and blows hot air toward the print medium 15. Alternatively, the drying unit 50 may be that which has an infrared light source and irradiates the print medium 15 with infrared rays.

A gas flow generating unit 60 is provided on the frame of the front end portion of the mount portion 11. The gas flow generating unit 60 generates a gas flow that flows from the front side to the rear side of the shuttle base unit 2 to generate a gas flow in the space 42 (refer to FIG. 3) which is formed among the lifting units 41 described above. Specifically, the gas flow generating unit 60 is provided with one or a plurality of fans, and generates the gas flow by driving the one or more fans. In addition, the gas flow generating unit 60 is preferably provided with heating means such as a heater in addition to the one or more fans to generate a flow of warm gas. By adopting such a configuration, the drying efficiency of the print medium 15 can be improved.

Figure 5:
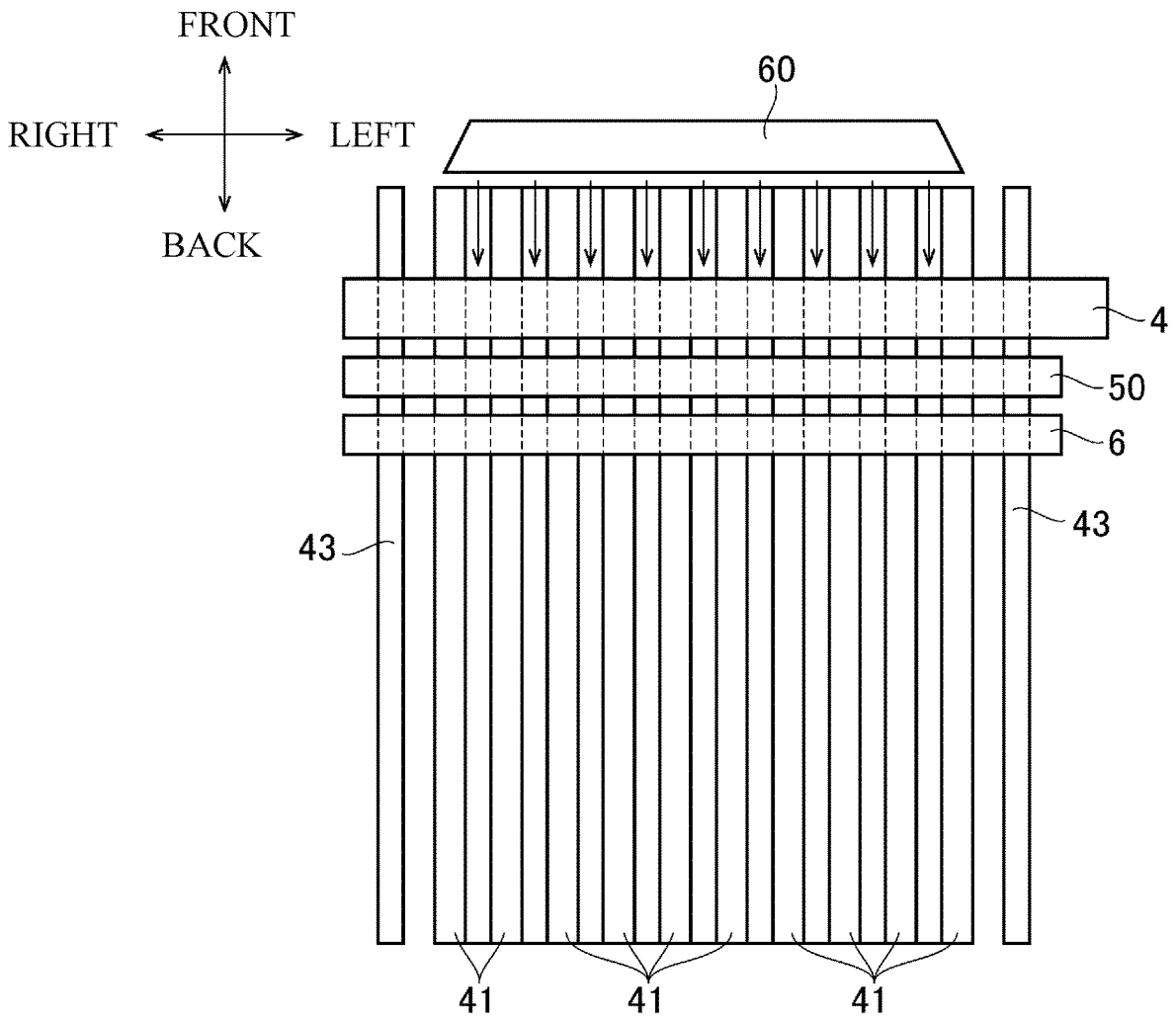
FIG. 5 is a diagram that illustrates the lifting units and a flow straightening member as viewed from above.

In addition, in the present embodiment, flow straightening members 43, which are rectangular parallelepiped shaped members, are provided at both sides in the left-right direction of the support member 40 constituted by the plurality of lifting units 41, in order to cause the gas flow generated by the gas flow generating unit 60 to flow efficiently into the spaces 42 among the lifting units 41, as illustrated in FIG. 3 and FIG. 5. Note that FIG. 5 is a diagram that illustrates the lifting units 41 and the flow straightening members 43 as viewed from above. The flow straightening members 43 may be configured to be detachable from the flat bed unit 3 or may be fixed on the flat bed unit 3.

Note that an intake unit (not illustrated) having an air intake aperture may be provided at the rear end side of the lifting units 41, in order to cause the gas flow generated in the gas flow generating unit 60 to flow more efficiently into the space 42 of the support member 40.

In addition, in the present embodiment, the support member 40 is provided in the flat bed unit 3 such that the direction in which the lifting units 41 extend matches the sub scanning direction. However, the present invention is not limited to such a configuration. For example, the gas flow generating unit 60 may be provided on the frame at the left or right end of the mount portion 11 so as to generate a gas flow flowing from the left side to the right side or the right side to the left side of the shuttle base unit 2. In this case, the support member 40 may be provided in the flat bed unit 3 such that the direction in which the lifting units 41 extend matches the left-right direction (main scanning direction). That is, it is only necessary for the direction of the gas flow generated by the gas flow generating unit 60 to match with the direction in which the lifting units 41 extend.

Figure 6:
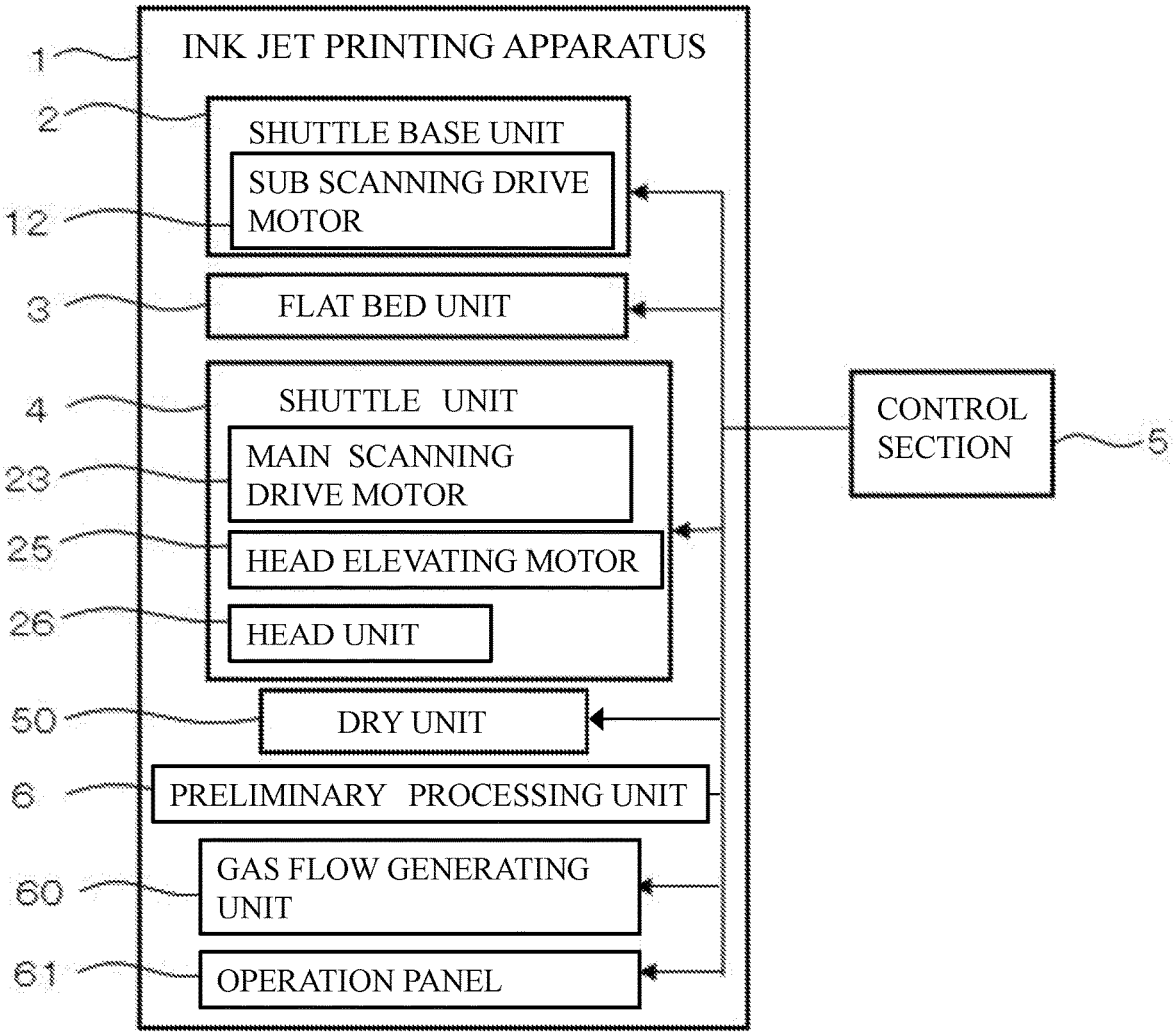
FIG. 6 is a block diagram that illustrates a control system of the inkjet printing apparatus of the first embodiment illustrated in FIG. 1.

FIG. 6 is a block diagram that illustrates the control system of the inkjet printing apparatus 1 of the present embodiment. The inkjet printing apparatus 1 is equipped with a control section 5 that controls the entire apparatus. The control section 5 is configured by a computer having a CPU (Central Processing Unit), a semiconductor memory, a hard disk, etc. The control section 5 controls each part illustrated in FIG. 6 by executing a program which is stored in advance in a storage medium such as a semiconductor memory or a hard disk, and by operating an electric circuit.

In addition, as illustrated in FIG. 6, the inkjet printing apparatus 1 is provided with an operation panel 61. The operation panel 61 is configured by, for example, a touch panel. The operation panel 61 displays various pieces of information such as an operation menu, and accepts various setting inputs from a user. Specifically, the operation panel 61 accepts setting inputs related to a printing process such as printing density, setting inputs of a heating temperature for the drying unit 50 described above, and setting inputs of gas flow volume and gas flow speed for the gas flow generating unit 60. The control section 5 controls each section based on data which are set and input via the operation panel 61.

Next, the operation of the inkjet printing apparatus 1 of the present embodiment will be described with reference to FIGS. 7A through 7E. FIGS. 7A through 7E illustrate the inkjet printing apparatus 1 illustrated in FIG. 1 as viewed from the left side thereof.

Figure 7A:
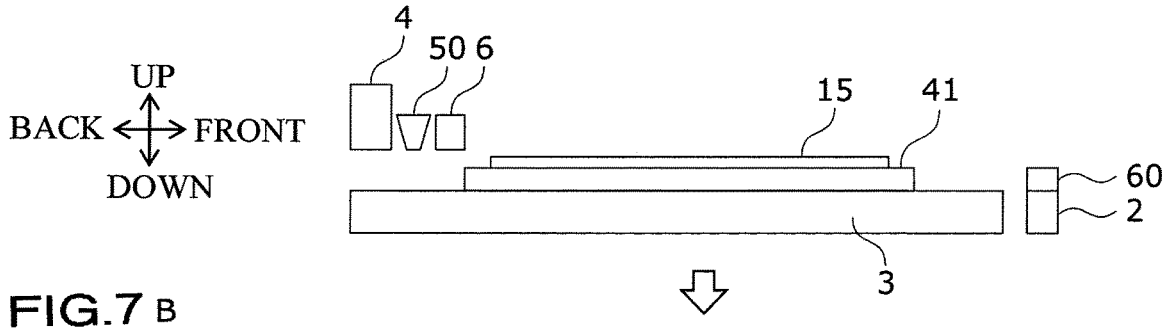
FIG. 7A is a diagram for explaining the operation of the inkjet printing apparatus of the first embodiment illustrated in FIG. 1.
Figure 7B:
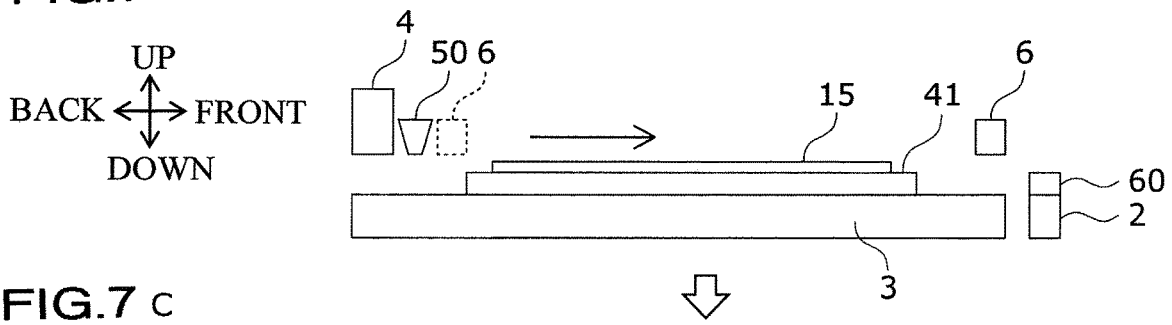
FIG. 7B is a diagram for explaining the operation of the inkjet printing apparatus of the first embodiment illustrated in FIG. 1.

First, a print medium 15 is placed on lifting units 41 in a state in which the lifting units 41 are protruding from flat bed unit 3, as illustrated in FIG. 7A. Next, the control section 5 controls the sub scanning drive motor 12 to move the preliminary processing unit 6 in the forward direction (the direction of the arrow illustrated in FIG. 7B) and operates the preliminary processing unit 6 to apply the preliminary processing fluid to print medium 15, to perform a preliminary process.

Figure 7C:
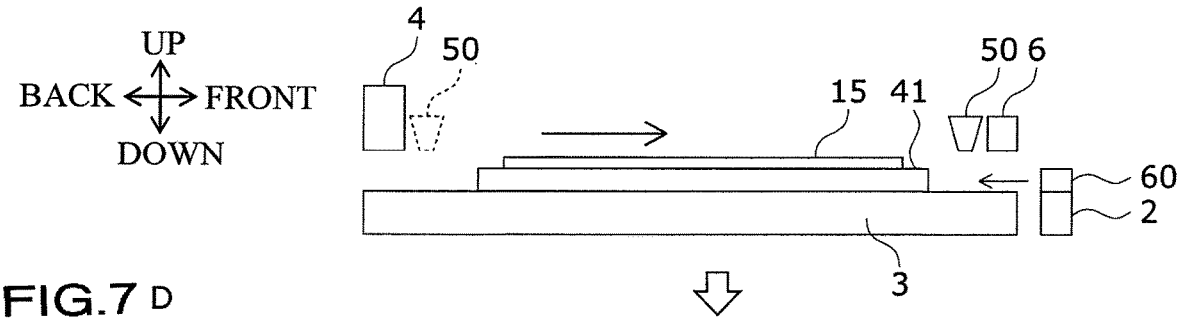
FIG. 7C is a diagram for explaining the operation of the inkjet printing apparatus of the first embodiment illustrated in FIG. 1.

Then, after the preliminary processing fluid is applied to the print medium 15 by the preliminary processing unit 6, the control section 5 controls the sub scanning drive motor 12 to move the drying unit 50 forward (the direction of the arrow illustrated in FIG. 7C).

At this time, the control section 5 sequentially heats the printing medium 15 along the forward direction by operating the drying unit 50 while moving the drying unit 50, the preliminary processing fluid contained in the print medium 15 evaporates, and the print medium 15 is dried. In addition, the control section 5 generates gas flow in the spaces 42 among the lifting units 41 by operating the gas flow generating unit 60 simultaneously with the drying operation of the drying unit 50. By the gas flow being generated, it is possible to smoothly exhaust the evaporated gas from the back side (underside) of the print medium 15, and to promote drying of the print medium 15.

Figure 7D:
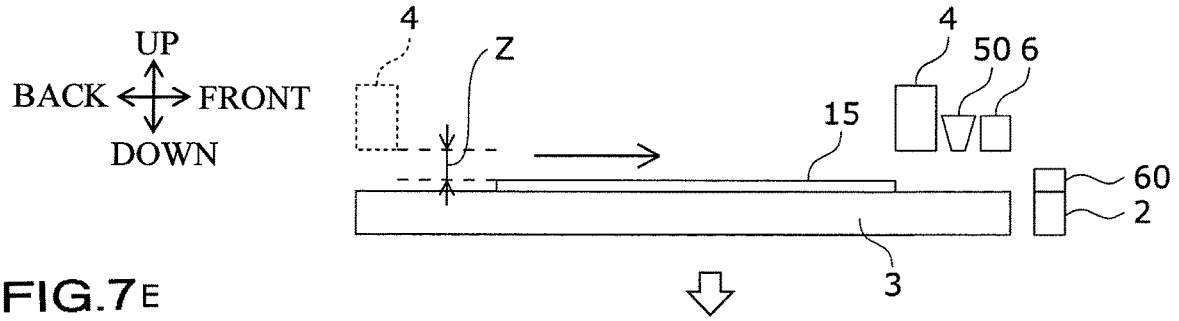
FIG. 7D is a diagram for explaining the operation of the inkjet printing apparatus of the first embodiment illustrated in FIG. 1.

Then, when the drying unit 50 moves to the drying operation completed position (the front end of FIG. 7C), the control section 5 causes the operation of the drying unit 50 and the gas flow generating unit 60 to cease, controls the support member elevating mechanism 30 to move the lifting units 41 downward such that they are housed in the flat bed unit 3. As a result, the print medium 15 is placed directly on the medium placement surface 3*a* of the flat bed unit 3 as illustrated in FIG. 7D. The distance between the print medium 15 and the head unit 26 is adjusted thereafter. Specifically, adjustments are conducted such that the distance Z (refer to FIG. 7D) between the print medium 15 placed on the medium placement surface 3*a* of the flat bed unit 3 and the inkjet head 31 in the shuttle unit 4 is 1.5 mm±0.5 mm. The distance between the print medium 15 and the head unit 26 may be adjusted by moving the head unit 26 in the vertical direction, or by moving the flat bed unit 3 in the vertical direction.

Next, the control section 5 controls the sub scanning drive motor 12 to perform a printing process while moving the shuttle unit 4 in the forward direction (the direction of the arrow illustrated in FIG. 7D), as illustrated in FIG. 7D. Specifically, the control section 5 moves the shuttle unit 4 to a print start position on the print medium 15. By controlling the main scanning drive motor 23 to move the head unit 26 in the main scanning direction, while controlling the inkjet head 31 based on an input print job to eject ink from the nozzle 37, printing for one pass is performed.

After printing for one pass is completed, the control section 5 controls the sub scanning drive motor 12 to move the shuttle unit 4 forward to the printing position of a next pass. The control section 5 forms an image on the print medium 15 by alternately repeating the printing of single passes and movement of the shuttle unit 4.

Figure 7E:
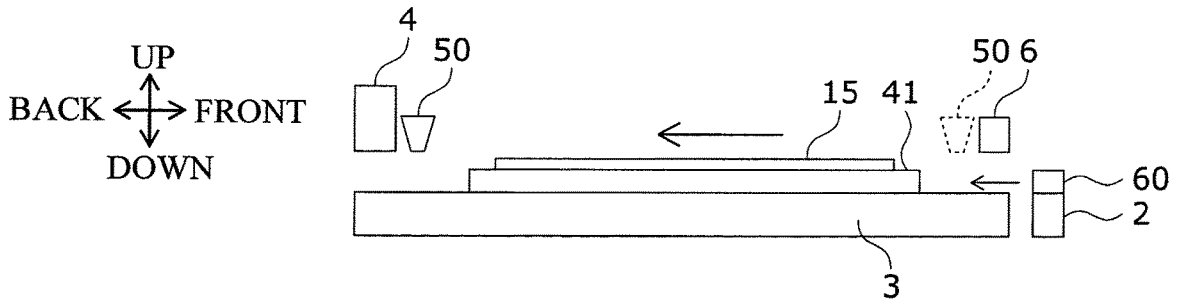
FIG. 7E is a diagram for explaining the operation of the inkjet printing apparatus of the first embodiment illustrated in FIG. 1.

When the printing of one sheet is completed, the shuttle unit 4 is placed at the initial position again, as illustrated in FIG. 7E. Thereafter, the control section 5 controls the support member elevating mechanism 30 to move the lifting units 41 upward such that they protrude from the flat bed unit 3 again. Next, the control section 5 controls the sub scanning drive motor 12 to move the drying unit 50 in the backward direction (the direction of the arrow illustrated in FIG. 7E), as illustrated in FIG. 7E.

At this time, the control section 5 sequentially heats the printing medium 15 along the backward direction by operating the drying unit 50 while moving the drying unit 50, to dry the ink which is attached to the print medium 15. In addition, the control section 5 generates a gas flow in the spaces 42 among the lifting units 41 by operating the gas flow generating unit 60 simultaneously with the drying operation of drying unit 50. By the gas flow being generated, it is possible to smoothly exhaust the evaporated gas from the back side (underside) of the print medium 15, and to promote drying of the print medium 15.

Thereafter, the control section 5 ceases the drying operation and the gas flow generating operation described above when the drying unit 50 reaches the rear end initial position illustrated in FIG. 7E. Next, control section 5 the places preliminary processing unit 6 in the rear end initial position illustrated in FIG. 7A, and the series of operations ends.

Note that post processing is not conducted in the above description. However, post processing may be conducted after printing depending on the type of print medium 15 or the type of ink. In this case, it is preferable for a post processing liquid to be applied to the print medium 15 after printing and then to carry out the drying operation and gas flow generating operation described above in a state in which the lifting units 41 are protruding from the flat bed unit 3.

Regarding a post processing unit for applying the post processing liquid to the print medium 15, for example, the post processing liquid may be supplied to the preliminary processing unit 6 instead of the preliminary processing fluid such that the preliminary processing unit 6 functions as both a preliminary processing unit and a post processing unit. Alternatively, a post processing unit having a similar configuration to that of the preliminary processing unit 6 may be provided separately.

Figure 8:
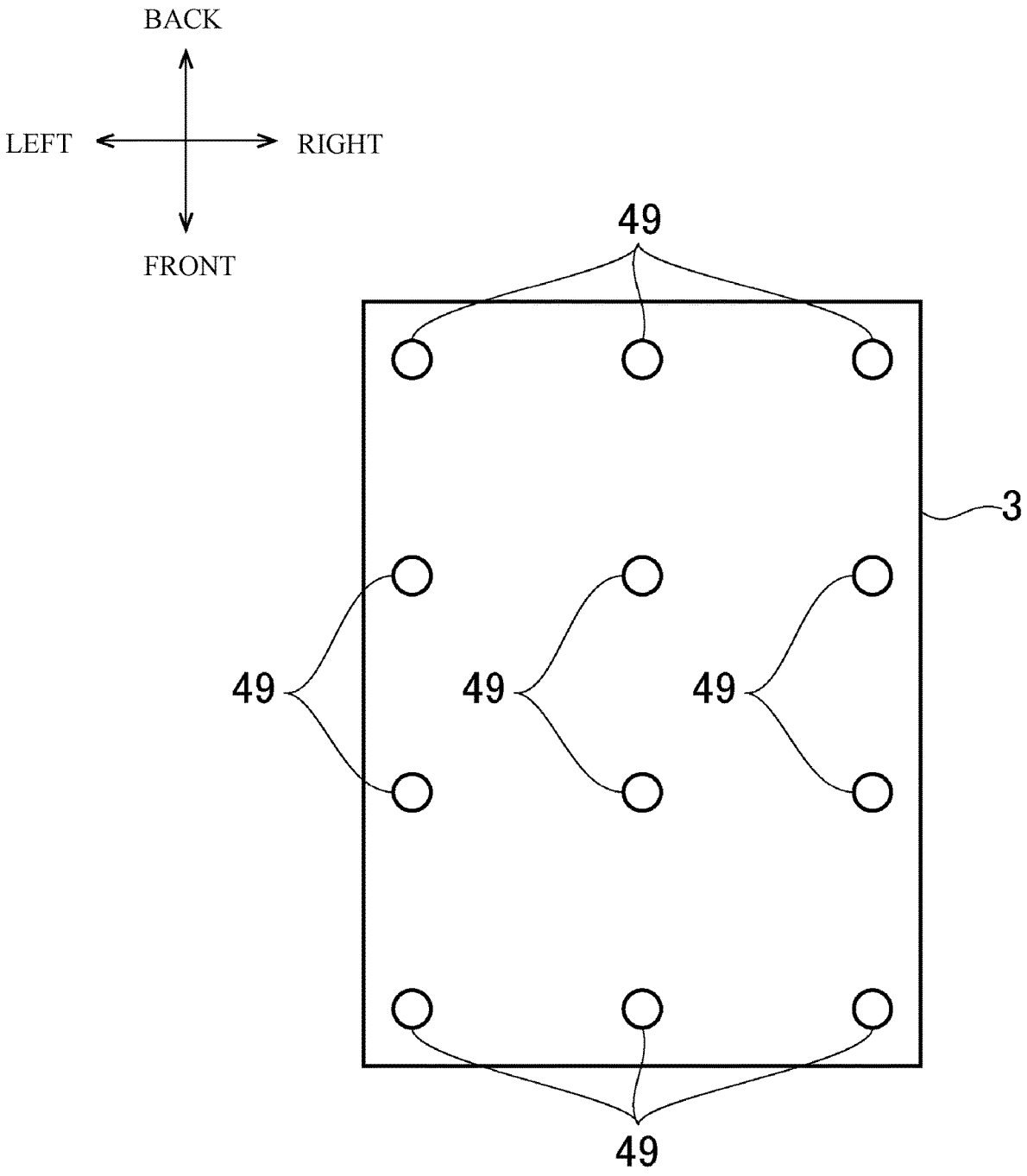
FIG. 8 is a plan view that illustrates another shape of the lifting units.
Figure 9:
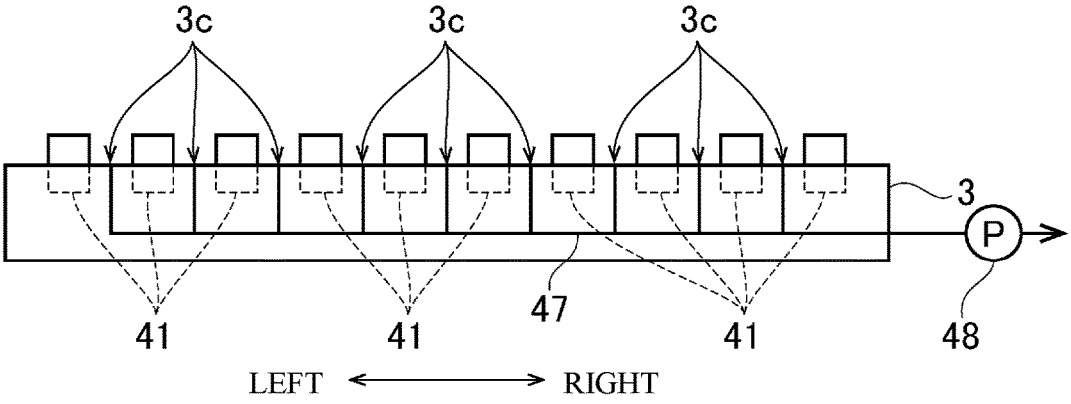
FIG. 9 is a diagram that illustrates an example of a suction type gas flow generating unit.

In addition, in the embodiment described above, rectangular parallelepiped members that extend in the sub scanning direction are employed as the lifting units 41. However, the present invention is not limited to such a configuration. For example, lifting units having columnar shape that extend in the up-down direction (vertical direction) may automatically enter and exit through the medium placement surface 3*a* of the flat bed unit 3. FIG. 8 is a plan view of lifting units 49 having the aforementioned columnar shapes that extend in the up-down direction. As illustrated in FIG. 8, it is preferable for the cylindrical lifting units 49 to be arranged uniformly on the medium placement surface 3*a* of the flat bed unit 3. In addition, it is preferable for the plurality of columnar lifting units 49 to be spaced apart from each other along an orthogonal direction (the left-right direction in the present embodiment) with respect to direction in which the gas flow is blown (the front-back direction in the present embodiment) by the gas flow generating unit 60. By adopting such a configuration, it will become possible to cause the gas flow generated by the gas flow generating unit 60 to flow efficiently among the lifting units 49, and also to secure the flatness of the print medium 15.

In addition, in the embodiment described above, a space is formed between the print medium 15 and the flat bed unit 3 by causing the lifting units 41 to protrude from the flat bed unit 3. However, the present invention is not limited to employing the lifting units 41. Other possible configurations may be that which grip the edges of the print medium and lift the print medium 15 upward, or that which suctions the print medium 15 to lift the print medium 15 upward. Such alternate configurations are also capable of forming a space between the print medium 15 and the flat bed unit 3. That is, any configuration may be employed as long as a space can be formed between the print medium 15 and the flat bed unit 3.

As still another alternative, a surface having concavities and convexities (grooves) may be formed in the medium placement surface 3*a* of the flat bed unit 3 itself, instead of providing the lifting units 41 as in the embodiment described above. A space may be formed between the print medium 15 and the flat bed unit 3 by the grooves achieving a configuration similar to the state in which the lifting units 41 are protruding.

In addition, a fan is employed as the gas flow generating unit 60 in the embodiment described above, and the gas flow is generated by blowing wind which is generated by the fan. However, the gas flow generating unit is limited to such a configuration. For example, in a configuration in which the lifting units 41 described above automatically enter and exit the flat bed unit 3, suctioning apertures 3*c* may be provided among the lifting units 41 and a suctioning pipe 47 within the flat bed unit 3 may be connected to the suctioning apertures 3*c*. A gas flow may be generated in the spaces among the lifting units 41, by suctioning air with a suction pump 48 connected to the suctioning pipe 47 to suction air. By generating the gas flow by suction in this manner, the influence imparted by wind on the periphery can be decreased compared to the case in which the gas flow is generated by blowing with a fan as in the embodiment described above.

In addition, in the embodiment described above, the lifting units 41 are housed in the flat bed unit 3 and the lifting units 41 automatically protrude to form a space between the print medium 15 and the flat bed unit 3. However, the present invention is not limited to this configuration. A space may be formed between the flat bed unit 3 and the print medium 15 by placing the print medium 15 on a support member which is formed separately on the flat bed unit 3.

Figure 10:
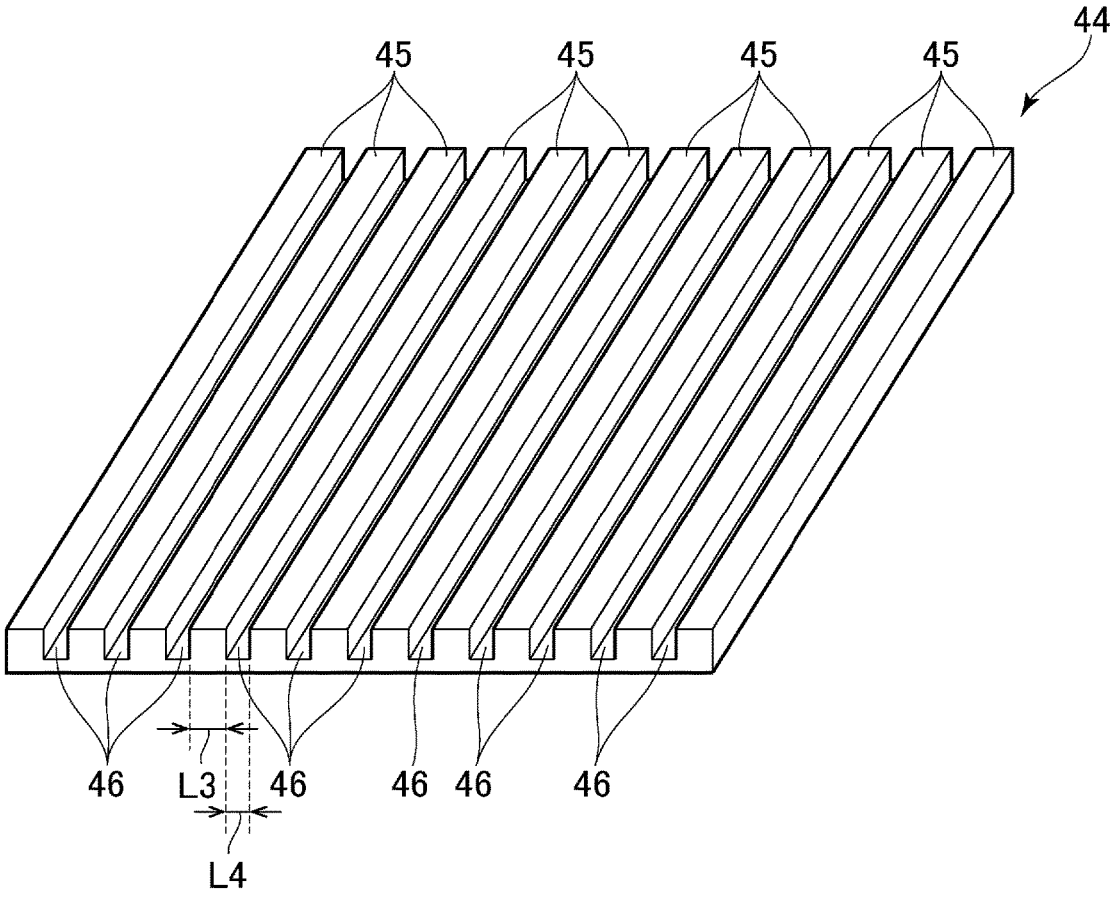
FIG. 10 is a diagram that illustrates an example of a support member, which is placed on a flat bed unit.

FIG. 10 is a diagram that illustrates an example of a support member 44 described above, which is placed on the flat bed unit 3 described above. Specifically, as illustrated in FIG. 10, the support member 44 is a plate shaped member having a predetermined thickness, and includes a plurality of protruding portions 45 having a rectangular parallelepiped shape extending in one direction in the horizontal direction, and recessed portions 46*a* which are formed in the protruding portions 45. The size (outer periphery) of the support member 44 is larger than the size of the print medium 15 which is expected to undergo a printing operation, and the print medium 15 is placed on the support member 44, to form the space with the recessed portions 46.

Regarding the relationship between the protruding portions 45 and the recessed portions 46 (spaces), the area of the portion where the support member 44 and the print medium 15 are in contact is smaller than the area of the entire lower surface of the print medium 15, and is preferably ⅔ or less. It is more preferable for the area to be ½ or less, and still more preferably ⅓ or less. In the case that the support member 44 illustrated in FIG. 10 is employed, if the width in the direction perpendicular to the direction in which the protruding portions 45 extend is designated as L3 and the width in the direction perpendicular to the direction in which the recessed portions 46 extend is designated as L4, it is preferable for $L3 \leq 2 \times L4$ to be satisfied, more preferably $L3 \leq L4$, and still more preferably $L3 \leq L4/2$.

The support member 44 is placed on the flat bed unit 3 such that the direction in which the protruding portions 45 extend matches with the sub scanning direction. In the present embodiment, the protruding portions 45 are formed as rectangular parallelepiped shapes that extend in the front-back direction (sub scanning direction). Therefore, it is possible for the gas flow which is generated by the gas flow generating unit 60 to flow efficiently within the recessed portions 46 of the support member 44, for the drying efficiency of the print medium 15 which is placed on the support member 44 to be improved.

In addition, it is possible to form a space easily between the print medium 15 and the flat bed unit 3 simply by placing the support member 44 on the flat bed unit 3. Further, if the support member 44 is removed from the flat bed unit 3, the print medium 15 can be placed directly on the flat bed unit 3, and the flatness of the print medium 15 can be secured thereby.

In addition, in the embodiment described above, the drying operation by the drying unit 50 and the gas flow generating operation by the gas flow generating unit 60 are performed to dry the preliminary processing fluid and the post processing liquid contained in the print medium 15. The amount of preliminary processing fluid and post processing liquid which is contained in print medium 15 may vary depending on the thickness of the print medium 15 and the size of the porous material.

Therefore, a table in which information regarding types of the print medium 15 with control conditions of the drying unit 50 and the gas flow generating unit 60 are correlated may be set in the control section 5, for example. The control conditions of the drying unit 50 and the gas flow generating unit 60 may be determined based on information regarding the type of the print medium 15 which is input as a setting. Thereby, it becomes possible for the print medium 15 to be appropriately dried even in cases that the thickness of the print medium and the size of the porous material are different.

Information regarding the types of the print medium 15 may be the product information of the print medium 15, information indicating thickness, or information indicating the size of the porous material. The information regarding the type of print medium 15 may be set and input via the operation panel 61, or may be set and input in a printer driver (computer) that outputs a print job to the inkjet printing apparatus 1. In addition, as for the thickness of the print medium 15, for example, control may be exerted by classifying thicknesses into three levels, such as thin, middle, and thick, and the control conditions may be changed for three levels, which may be less than 3 mm, 3 mm or greater and less than 5 mm, and 5 mm or greater.

In addition, the heating temperature is a control condition of the drying unit 50. In the case that a fan is employed as the drying unit 50, gas flow volume and wind speed may also be included as control conditions. Further, gas flow volume and wind speed are control conditions of the gas flow generating unit 60. In the case that the gas flow generating unit 60 is that which generates warm gas, the temperature of the warm gas may also be included as a control condition.

Further, in the case that the drying operation and the gas flow generating operation are performed in order to dry the ink after a printing process, a table in which the total amounts of ejected ink required for printing processes and control conditions for the drying unit 50 and the gas flow generating unit 60 are correlated may be prepared. Control conditions for the drying unit 50 and the gas flow generating unit 60 may be determined based on the total amount of ejected ink. Note that the gas flow volume and the gas flow speed are set to be greater and the temperature is also set to be higher as the total amount of ejected ink increases.

The total amount of ejected ink may be set via the operation panel 61, or may be set and input in a printer driver (computer) that outputs a print job to the inkjet printing apparatus 1. Alternatively, the total amount of ejected ink may be calculated from the data size of image data to be printed, which is included in the print job.

In the inkjet printing apparatus 1 of the embodiment described above, the shuttle unit 4 is moved relative to the print medium 15 (flat bed unit 3) to perform scanning in the sub scanning direction. However, the present invention is not limited to such a configuration. Alternatively, the shuttle unit 4 may be fixed and the print medium 15 (flat bed unit 3) may be moved, or both of the shuttle unit 4 and the print medium 15 (flat bed unit 3) may be moved.

In the embodiment described above, the position in the up down direction of the print medium 15 may be adjusted according to the thickness of the print medium 15. Specifically, if the thickness of print medium 15 is thick, the lifting units 41 or 49 may be lowered to lower the position of print medium 15, and the thickness of print medium 15 is thin, the lifting units 41 or 49 may be raised to raise the position of the print medium 15, for example. By adopting such a configuration, it will become possible to maintain the distance between the print medium 15 and the drying unit 50 at a constant distance, and the drying efficiency can be maintained. As a method for adjusting the position of the print medium 15, not only can the lifting units 41 or 49 be raised and lowered, but also the flat bed unit 3 may be raised and lowered in the up down direction. Further, after roughly adjusting the position of the print medium 15 by adjusting the height of the flat bed unit 3, fine adjustments may be performed by raising and lowering the lifting units 41 or 49. In addition, as another method for maintaining the distance between the print medium 15 and the drying unit 50 constant, the drying unit 50 may be raised and lowered employing an adjusting mechanism that includes a predetermined actuator.

Figure 11:
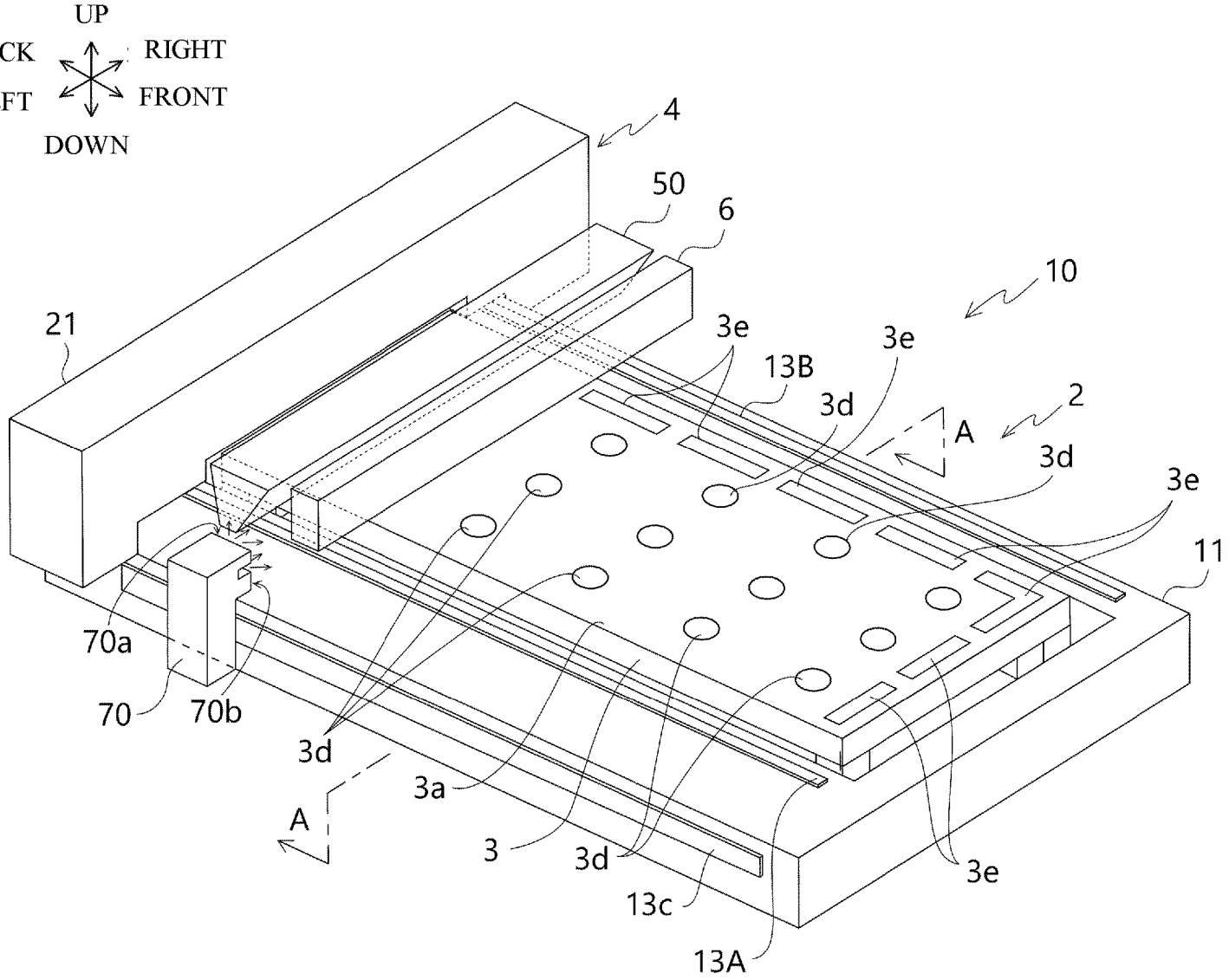
FIG. 11 is a perspective view that illustrates the schematic configuration of an inkjet apparatus according to a second embodiment.

Next, an inkjet printing apparatus 10 according to a second embodiment of the present invention will be described in detail. FIG. 11 is a schematic diagram that illustrates the configuration of the inkjet printing apparatus 10 of the second embodiment. The inkjet printing apparatus 10 of the second embodiment differs from the inkjet printing apparatus 1 of the first embodiment equipped with the gas flow generating unit 60 illustrated in FIG. 1 in that the inkjet printing apparatus 10 has a suctioning mechanism in order to further expedite drying after the print medium 15 is coated with the preliminary processing fluid. In addition, the inkjet printing apparatus 10 is provided with position determining members capable of positioning the print medium 15 such that it does not shift during printing. Further, the mounting position and the configuration of a gas flow generating unit 70 differs from those of the inkjet printing apparatus 1 of the first embodiment. The position determining members are members that determine the position of the print medium 15 on the medium placement surface 3*a* (within the horizontal plane). Note that configurations which are similar to those of the inkjet printing apparatus 1 of the first embodiment are denoted by the same reference numerals and descriptions thereof will be omitted. The inkjet printing apparatus 10 of the second embodiment will be described in detail hereinafter, focusing on the points of difference from the inkjet printing apparatus 1 of the first embodiment.

Figure 12:
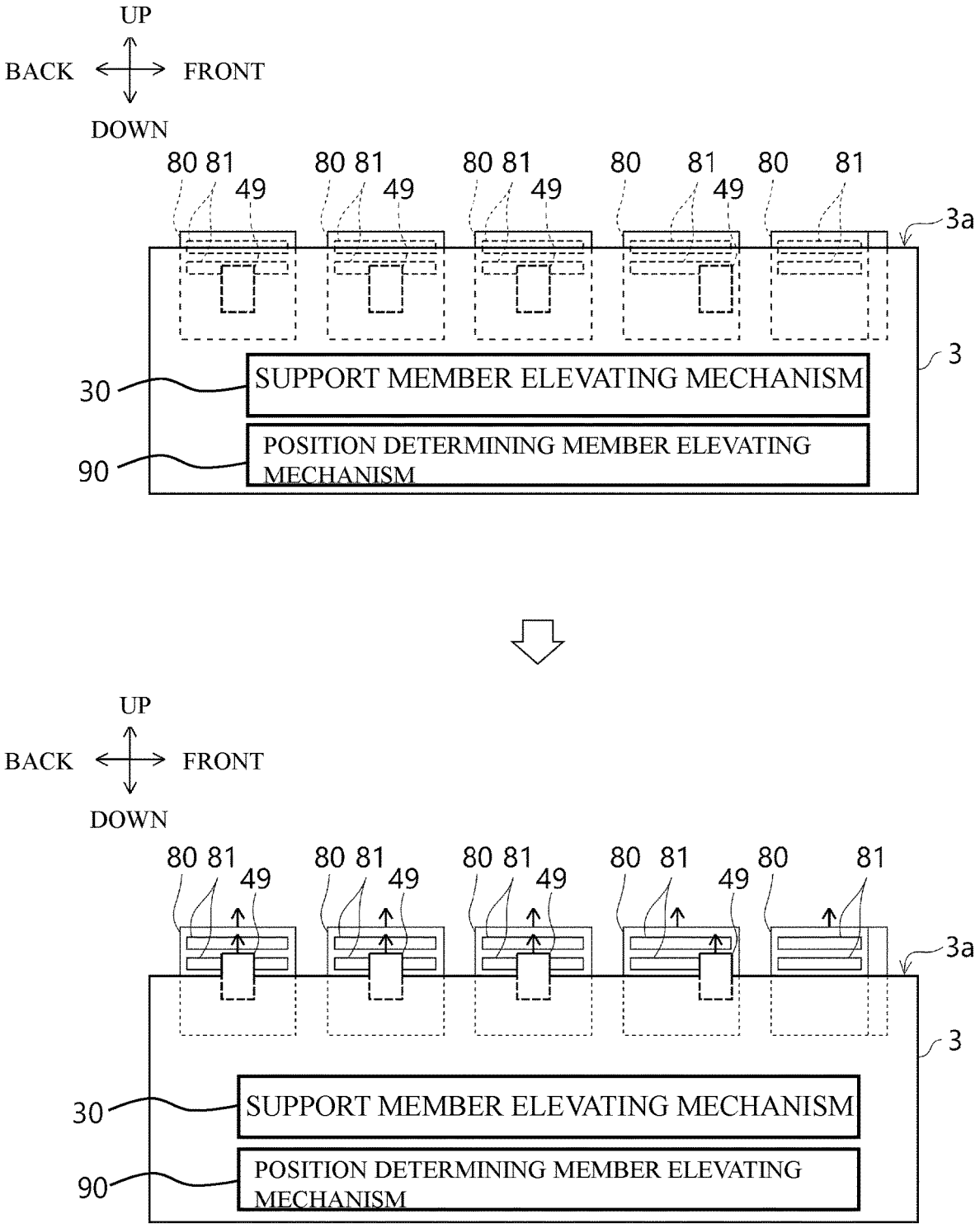
FIG. 12 is a diagram for explaining the operations of the lifting units and a position determining member.

The inkjet printing apparatus 10 of the present embodiment has the cylindrical lifting units 49 and the position determining members 80 (refer to FIG. 12). The lifting units 49 and the position determining members 80 are configured to be capable of being housed in the flat bed unit 3. FIG. 11 is a diagram that illustrates a state in which the lifting units 49 and position determining members 80 are housed in the flat bed unit 3.

As illustrated in FIG. 11, first passage apertures 3*d*, through which the lifting units 49 pass when they protrude from the flat bed unit 3, and a second passage apertures 3*e*, through which the positioning determining members 80 pass when they protrude from the flat bed unit 3, are formed in the surface of the flat bed unit 3. The first passage apertures 3*d* are formed according to the shape of the lifting units 49. In the present embodiment, the first passage apertures 3*d* are formed as circular shapes. The second passage apertures 3*e* are formed according to the shape of the position determining members 80. In the present embodiment, the second passage apertures 3*e* are formed in rectangular shapes and an L shape.

As in the first embodiment, the plurality of lifting units 49 are accommodated in the flat bed unit 3 during a printing operation as illustrated in the upper portion of FIG. 12. Meanwhile, during a drying operation of the print medium 15 and a gas flow generating operation, which will be described later, the lifting units 49 move upward and protrude from the medium placement surface 3*a* of the flat bed unit 3 as illustrated in the lower portion of FIG. 12. A support member elevating mechanism 30 that moves the lifting units 49 in the up-down direction (vertical direction) is provided within the flat bed unit 3. The support member elevating mechanism 30 has a predetermined actuator.

By causing the lifting units 49 to protrude from the medium placement surface 3*a* of the flat bed unit 3 employing the support member elevating mechanism 30 in this manner, a space is formed between the print medium 15 and the flat bed unit 3 placed on the lifting units 49. Thereby, a gas flow generated by the gas flow generating unit 70 can flow through the space. Meanwhile, when performing a printing operation, the support member elevating mechanism 30 moves the lifting units 49 downward, and the lifting units 49 are housed in the flat bed unit 3, as described above. As a result, the print medium 15 can be placed directly on the medium placement surface 3*a* of the flat bed unit 3, so that the flatness (horizontal property) of the print medium 15 can be secured and the image quality of the printed image will be guaranteed.

Rectangular parallelepiped position determining members 80 having a rectangular cross section in the horizontal direction and a wall shaped position determining member 80 having an L shaped cross section in the horizontal direction that extend in the vertical direction are provided as the position determining members 80. The L shaped position determining member 80 is provided at the right corner of the front end of the flat bed unit 3 as indicated by the second passage aperture 3*e* at this position in FIG. 11. The position determining members 80 having rectangular parallelepiped shapes are provided to face an upper exhaust port 70*a* and a lower exhaust port 70*b* of the gas flow generating unit 70 to be described later. A plurality of the position determining members 80 having rectangular parallelepiped shapes are provided at the peripheral edge of the flat bed unit 3 that extends in the sub scanning direction, and a plurality of the position determining members 80 having rectangular parallelepiped shapes are provided on the peripheral edge of the front end of the flood bed unit 3 that extends in the main scanning direction. In addition, the position determining members 80 are arranged such that the gas flow passes over the entirety of the medium placement surface 3*a* during the drying operation, in order to remove the water vapor which is generated on the upper surface and the lower surface of the print medium 15. In the present embodiment, the rectangular parallelepiped position determining members 80 are arranged in the front-back direction and the left-right direction along the horizontal extending direction of the L-shaped position determining member 80. More specifically, as indicated by the second passage apertures in FIG. 11, four rectangular parallelepiped position determining members 80 are arranged in the front-back direction, and two rectangular parallelepiped position determining members 80 are arranged in the left-right direction.

The gas flow generating unit 70 is configured to move in the sub scanning direction (front-back direction) while blowing gas flow radially or unidirectionally in the front-back direction from the upper exhaust port 70*a* and the lower exhaust port 70*b*. The gas flow generating unit 70 is configured to such that the gas flow generated thereby is efficiently suctioned by the position determining members 80, a plurality of which are arranged in the front-back direction and the let-right direction on the flat bed unit 3. Note that with respect to the number of position determining members 80, it is preferable for at least two or more position determining members 80 to be provided for one gas flow generating unit 70, in order to suction the gas flow generated by the gas flow generating unit 70 and to position the print medium 15. In addition, in the present embodiment, the gas flow generating unit 70 is configured to move in the sub scanning direction. However, instead of the gas flow generating unit 70 moving in this manner, a plurality of gas flow generating units 70 may be arranged side by side in the sub scanning direction, and a gas flow may be blown radially or unidirectionally from each of the respective gas flow generating units 70. In addition, a single gas flow generating unit 70 may be fixedly provided so as to blow a gas flow in a broad radial direction toward the entirety of the medium placement surface 3*a* of the flood bed unit 3.

In addition, a position determining member elevating mechanism 90 (refer to FIG. 12) that moves the position determining members 80 in the up-down direction (vertical direction) is provided in the flat bed unit 3. The position determining member elevating mechanism 90 has a predetermined actuator.

Figure 13:
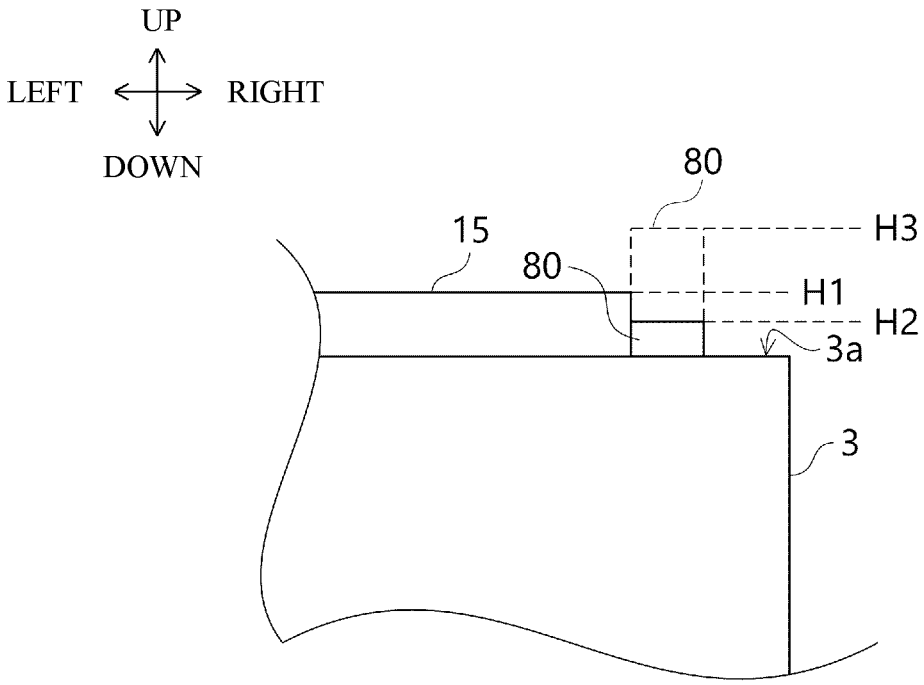
FIG. 13 is a diagram for explaining an example of a relationship between the upper surface of the position determining member and the thickness of a print medium during a printing operation.

During a printing operation, the plurality of position determining members 80 protrude from the medium placement surface 3*a* of the flat bed unit 3 to a predetermined height, as illustrated in the upper portion of FIG. 12. Regarding this height, a height H2 from the medium placement surface 3 a on the upper surface of the position determining members 80 is set to be less than or equal to a thickness H1 of the print medium 15 which is placed on the medium placement surface 3*a*, as illustrated in FIG. 13. By setting the height of the position determining members 80 as described above, it is possible to position the print medium 15 within the medium placement surface 3*a* by bringing the print medium 15 into contact with the position determining members 80. In addition, it is possible to prevent the shuttle unit 4 (head unit 26), which is positioned above the print medium 15 during the printing operation, from colliding with the position determining members 80.

Meanwhile, during a drying operation of the preliminary processing fluid and ink of the print medium 15 and a gas flow generating operation, the plurality of position determining members 80 move further upward than during the printing operation, as illustrated in the lower portion of FIG. 12. The upper surfaces of the position determining members 80 move to a position H3 higher than the upper surface of the print medium 15 which is placed on the lifting units, 49 as illustrated in FIG. 13. As illustrated in FIG. 12, suction ports 81 are formed on the inner surface of each of the position determining members 80 on the side toward the print medium 15. The position determining members 80 suction the gas flow through these suction ports 81. By raising the position determining members 80 up to the aforementioned position H3 and performing the suction operation during the drying operation of the print medium 15 and the gas flow generating operation, the gas flow which is generated by the gas flow generating unit 70 on the upper side and the lower side of the print medium 15 can be efficiently suctioned. As a result, drying efficiency can be improved. That is, the gas flow which is generated radially from the gas flow generating unit 70 is suctioned and collected by the position determining members 80 which are provided at positions that face the gas flow generating unit 70. Thereby, it becomes possible to cause the gas to flow at a greater speed across the upper side and the lower side of the print medium 15, thereby improving the drying efficiency of the print medium 15. In addition, since it is possible to control the flow velocity distribution of the gas flow that flows on the upper side and the lower side of the print medium 15, the print medium 15 can be prevented from being dried unevenly.

In addition, by providing the position determination members 80 with a suctioning mechanism for suctioning the gas flow (both the gas flow generated during internal circulation to be described later and gas flow generated during exhaust to the exterior) blown from the gas flow generating unit 70, it will be unnecessary to provide members for positioning and a suctioning mechanism. As a result, the apparatus can be miniaturized, and cost reduction can also be achieved.

Note that the suction ports 81 are not necessarily provided in all of the position determining members 80, but may be provided at least in the position determining members 80 arranged at positions that face the gas flow generating unit 70. That is, in the case of the present embodiment, it is not necessary to provide the suction ports 81 in the two position determining members 80 which are arranged in the left-right direction.

In the present embodiment, two rectangular suction ports 81 are formed arrayed in the up-down direction in each position determining members 80, as illustrated in FIG. 12. However, the shape and number of the suction ports 81 are not limited to such a configuration. One, or three or more suction ports 81 may be formed, and circular or elliptical suction ports 81 may be provided.

The configurations of the shuttle unit 4, the drying unit 50 and the preliminary processing unit 6 are the same as those of the first embodiment described above.

In the inkjet printing apparatus 10 of the present embodiment, a sub scanning drive guide 13C is provided on the left side surface of the mount portion 11 of the shuttle base unit 2, as illustrated in FIG. 11. The sub scanning drive guide 13C guides the gas flow generating unit 70 to move in the front-back direction. The gas flow generating unit 70 of the present embodiment is installed on the left side surface of the mount portion 11 which is provided with the sub scanning drive guide 13C, and is moved in the front-back direction together with the drying unit 50 by the sub scanning drive motor 12.

Figure 14:
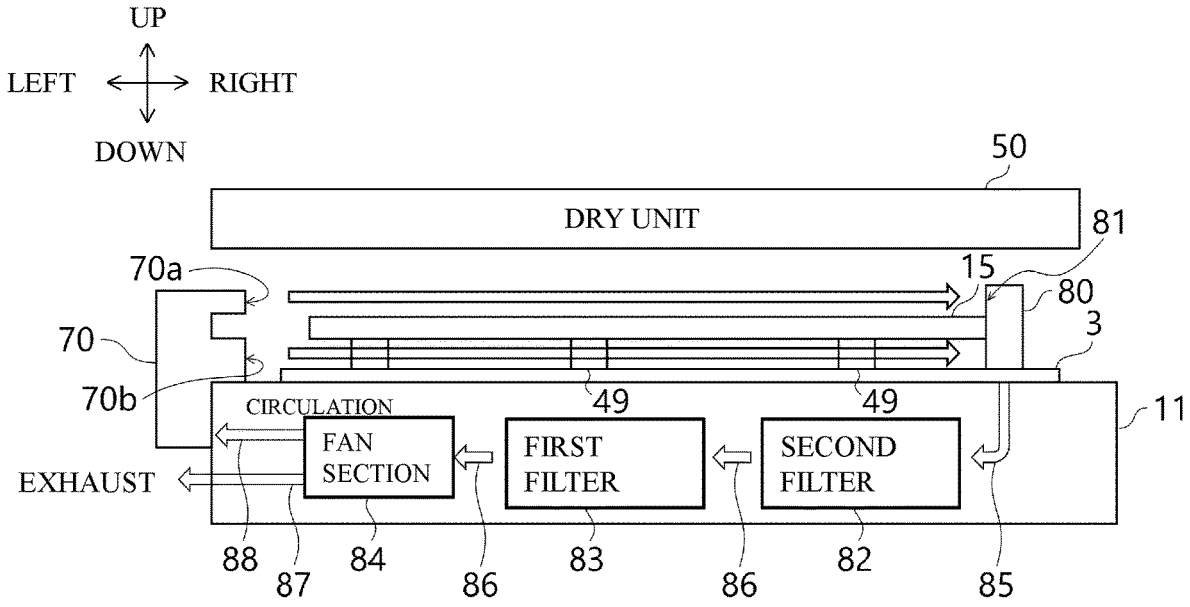
FIG. 14 is a cross sectional diagram of the second inkjet printing apparatus illustrated in FIG. 11 taken along line A-A.

The gas flow generating unit 70 of the present embodiment generates a gas flow flowing from the left side to the right side of the shuttle base unit 2 to generate gas flows at the upper side and the lower side of the print medium 15 which is supported by lifting units 49. Specifically, the gas flow generating unit 70 is provided with one or a plurality of fans, and generates the gas flow by driving the one or more fans. In addition, the gas flow generating unit 70 of the present embodiment has the upper exhaust port 70*a* and the lower exhaust port 70*b*, as illustrated in FIG. 11. FIG. 14 is a cross sectional view of the inkjet printing apparatus 10 illustrated in FIG. 11 in the direction of the arrow A-A that illustrates a in which the lifting units 49 and position determining members 80 are protruding from the flat bed unit 3 and the print medium 15 is placed on the lifting units 49.

As illustrated in FIG. 14, the gas flow generating unit 70 is configured such that it is located near the bottom of the drying unit 50. The upper exhaust port 70*a* is located above the upper surface of the print medium 15 which is expected to undergo a printing operation, and the lower exhaust port 70*b* is located below the lower surface of the print medium 15. By causing the gas flow which is exhausted from the upper exhaust port 70*a* to flow along the upper side of the print medium 15 and by causing the gas flow which is exhausted from the lower exhaust port 70*b* along the lower side of the print medium 15, it becomes possible to efficiently generate gas flows at both sides of the print medium 15. As a result, drying of the print medium 15 can be promoted further.

Note that the gas flow generating unit 70 may be raised or lowered in the vertical direction according to the type of print medium 15 in order to generate gas flow more efficiently at both sides of the print medium 15. The gas flow generating unit 70 may be configured such that the distance between the upper exhaust port 70*a* and the lower exhaust port 70*b* is changeable according to the thickness of print medium 15.

In addition, it is not necessary for the gas flow generating unit 70 to have two exhaust ports. A configuration may be adopted in which gas flow which is exhausted from one exhaust port flows on both sides of the print medium 15. Further, it is preferable for the wind speed of the gas flow generated by the gas flow generating unit 70 to be within a range from 7 msec to 9 m/sec. Drying can be accelerated by setting the wind speed to 7 m/sec or greater, and heat generated by the drying unit 50 can be efficiently circulated by setting the wind speed to 9 msec or less.

The gas flow which is exhausted from the gas flow generating unit 70 is suctioned by the suction ports 81 of the position determining members 80 after passing through the upper side and the lower side of the print medium 15.

An intake pipe 85, a first filter 82, a second filter 83, a fan section 84, a vent pipe 86, an exhaust pipe 87, and a circulation pipe 88 are provided in the mount portion 11 of the shuttle base unit 2. These elements constitute a circulation exhaust mechanism. By operation of the fan section 84, the gas flow is suctioned from the suction ports 81 of the position determining members 80, and the gas flow which is suctioned flows through the first filter 82 and the second filter into the circulation pipe 88, to return to the gas flow generating unit 70 (internal circulation), or is exhausted to the exterior of the apparatus by the exhaust pipe 87 (exhaust to the exterior)

One end of the intake pipe 85 is connected to the suction ports 81 within the position determining members 80 and the other end is connected to the first filter 82. The gas flow which is suctioned through the suction ports 81 of the position determining members 80 is supplied to the first filter 82.

The first filter 82 is a filter that removes moisture from the gas flow supplied thereto, and is constituted by a silica gel zeolite filter, for example. Note that the first filter 82 is not limited to being a silica gel zeolite filter, and other known filters may be employed, as long as they are capable of removing moisture. The gas flow, from which the moisture has been removed by the first filter 82, is supplied to the second filter 83 via the vent pipe 86.

The second filter 83 is a filter that removes odors from the gas flow supplied thereto, and is constituted by an activated carbon filter, for example. Note that the second filter 83 is not limited to being an activated carbon filter, and any other known filter may be used as long as they are capable of removing odors. The gas flow from which the odors are removed by the second filter 83 is supplied to the fan section 84 via the vent pipe 86.

If the amount of moisture in the gas flow supplied to the second filter 83 is great, there is a risk of influencing the performance and durability of the second filter 83. Therefore, although it is preferable to provide the second filter 83 that removes odors at a stage after the first filter 82 that removes moisture as in the present embodiment, the present invention is not limited to this order of filters. That is, the first filter 82 may be provided at a stage after the second filter 83.

In addition, two filters are provided in the present embodiment. However, but the present invention is not limited to such a configuration. Only one of the filters may be provided, or a plurality of types of filters that remove odors may be provided, for example.

The fan section 84 is equipped with a fan and a switching section for switching the exhaust destination of gas flow supplied thereto between the circulation pipe 88 and the exhaust pipe 87. The fan section 84 performs the suction operation through the suction port 81 of the position determining members 80 by operating the fan under the control of the control section 5, and operates the switching section to switch between exhaust to the circulation pipe 88 and exhaust to the exhaust pipe 87.

In the case that exhaust is switched to the exhaust to the circulation pipe 88 by the switching section, the gas flow supplied to the fan section 84 is supplied to the gas flow generating unit 70, and is exhausted from the upper exhaust port 70*a* and the lower exhaust port 70*b* again, and then suctioned through the suction ports 81 of the position determining members 80. Thereby, the gas flow internally circulates within the apparatus. In contrast, in the case that exhaust is switched to the exhaust pipe 87 by the switching section, the gas flow supplied to the fan section 84 is discharged to the exterior of the apparatus.

Regarding the switching between the exhaust to the circulation pipe 88 and the exhaust to the exhaust pipe 87, in the case that the amount of preliminary processing fluid applied to the print medium 15 is great or the amount of ink is great, the amount of moisture in the circulating gas flow will increase. As a result, the moisture will not be removed by the gas flow passing through the first filter 82, and there is a possibility that the drying time of the print medium 15 will become long. Therefore, in such a case, the fan section 84 causes the gas flow to be internally circulated in the apparatus so that the gas flow passes through the first filter 82 a plurality of times. Thereby, the drying of the print medium 15 can be promoted further. Conversely, if the preliminary processing fluid and the ink amount are not considerably great, it is not necessary for the gas flow to pass through the first filter 82 a plurality of times. Therefore, the fan section 84 exhausts the gas flow to the exhaust pipe 87 such that the gas flow is exhausted to the exterior.

Depending on the amount or the type of preliminary processing fluid and ink which is applied to the print medium 15, there may be a strong odor in the vicinity of the flood bed unit 3 and the print medium 15 itself may also have a strong odor immediately after coating. There are cases in which the aforementioned second filter 83 cannot completely remove the order. As a result, the odor in the vicinity of the apparatus will become stronger, and the working environment may deteriorate. Therefore, in such a case, the fan section 84 exhausts the gas flow to the exhaust pipe 87 without internally circulating the gas flow within the apparatus in order to exhaust the gas flow to the exterior, thereby diffusing the odor and decreasing the concentration of the odor, to improve the working environment. Conversely, if the odor of the preliminary processing fluid and the ink amount is not strong, the fan section 84 exhausts to the circulation pipe 88 to internally circulate the gas flow. This makes it possible to increase the utilization efficiency of warm air.

With regard to the above-described exhaust switching in the fan section 84, a user may set and input switching commands, or the switching may be conducted automatically. In the case that switching of the exhaust destination from the fan section 84 is conducted automatically, the control section 5 may obtain information regarding the amount of preliminary processing fluid or the total amount of ejected ink required for printing processing, and employs a preset profile, table or the like to conduct automatic switching according to the amount, for example. Alternatively, the control section 5 may acquire information regarding the type of preliminary processing fluid or ink, and conduct automatic switching according to the type by employing a preset profile, table, or the like. Information regarding the amount or the type of preliminary processing fluid or information regarding the total amount of ejected ink or ink type may be set by user input or may be included in the print job, and the control section 5 may be obtain the information from the print job.

Further, the amount of moisture circulating in the apparatus may be measured directly, and switching between exhaust to the circulating pipe 88 (internal circulation) and exhaust to the exhaust pipe 87 (exhaust to the exterior) may be performed based on the results of measurement. Specifically, a measurement unit that measures the amount of moisture of the gas flow may be provided between the first filter 82 and the second filter 83, between the second filter 83 and the fan section 84, or the like. In the case that the amount of moisture measured by the measurement unit is less than a threshold value which is set in advance, the control section 5 may switch exhaust to the exhaust pipe 87. In the case that the amount of moisture measured by the measurement unit is greater than or equal to the threshold value, the control section 5 may switch exhaust to the circulation pipe 88. In addition, the control section 5 may monitor the amount of moisture of gas flow in real time, and switch from exhaust to the circulation pipe 88 to exhaust to the exhaust pipe 87 in the case that the amount of moisture becomes less than the threshold value from being greater than or equal to the threshold value.

Regarding control systems of the inkjet printing apparatus 10 of the present embodiment, it is the same as that of the inkjet printing apparatus 1 of the first embodiment, other than control systems specific to the present embodiment.

Next, the operation of the ink presentation apparatus 10 of the present embodiment will be described with reference to FIGS. 15A through 15E. FIGS. 15A through 15E are a collection of diagrams of the inkjet printing apparatus 10 illustrated in FIG. 1, as viewed from the left side.

Figure 15A:
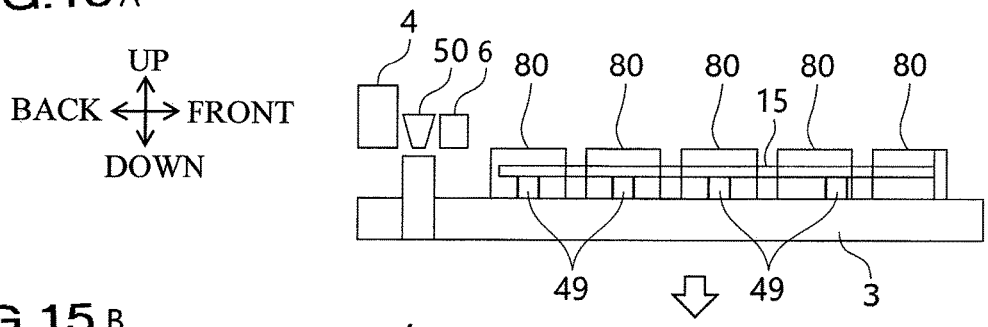
FIG. 15A is a collection of explanatory diagrams for explaining the operation of the inkjet printing apparatus of the second embodiment illustrated in FIG. 11
Figure 15B:
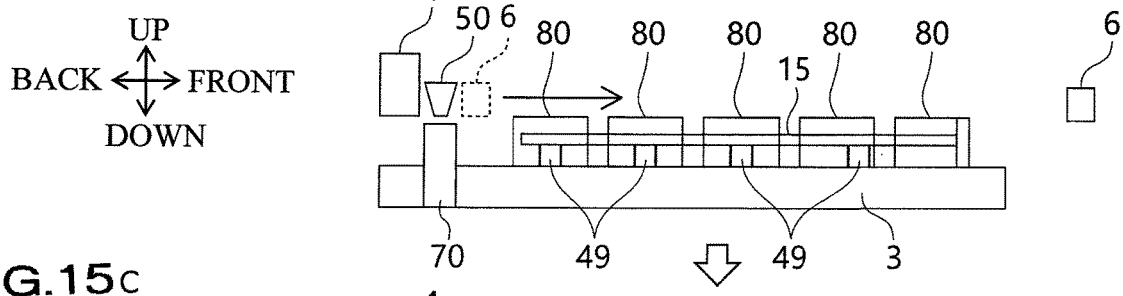
FIG. 15B is a collection of explanatory diagrams for explaining the operation of the inkjet printing apparatus of the second embodiment illustrated in FIG. 11

First, as illustrated in FIG. 15A, the print medium 15 is placed on the lifting units 49 in a state in which the lifting units 49 and the position determining members 80 are protruding from the flat bed unit 3. At this time, it is preferable for the print medium 15 to be places such that one corner of the print medium 15 abuts the L shaped position determining members 80, and the two sides of the print medium 15 that form the corner abut the rectangular parallelepiped position determining members 80. However, a certain degree of clearance may be provided between the print medium 15 and the position determining members 80 during the preliminary process.

Next, the control section 5 controls the sub scanning drive motor 12 to move the preliminary processing unit 6 in the forward direction (the direction of the arrow illustrated in FIG. 15B) and causes the preliminary processing unit 6 to operate, to coat the print medium with the preliminary processing fluid, to administer the preliminary process.

Figure 15C:
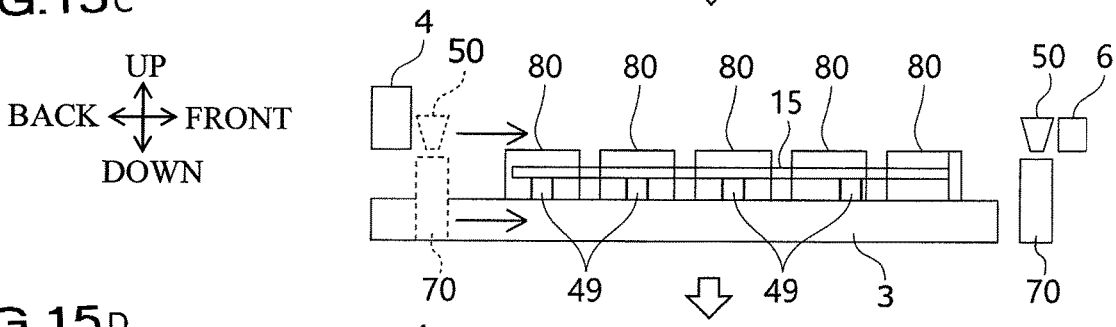
FIG. 15C is a collection of explanatory diagrams for explaining the operation of the inkjet printing apparatus of the second embodiment illustrated in FIG. 11

After the print medium 15 is coated with the preliminary processing fluid by the preliminary processing unit 6, the control section 5 controls the sub scanning drive motor 12 to move the drying unit 50 and the gas flow generating unit 70 in the forward direction (the direction of the arrow illustrated in FIG. 15C) as illustrated in FIG. 15C.

In addition, the control section 5 sequentially heats the printing medium 15 along the forward direction by operating the drying unit 50 while moving the drying unit 50 at this time. Thereby, the preliminary processing fluid contained in the print medium 15 evaporates and dries. Further, the control section 5 generates gas flow above and below the print medium 15 by operating the gas flow generating unit 70 simultaneously with the drying operation of the drying unit 50. Still further, the control section 5 performs the suction operation through the suction ports 81 of the position determining members 80 by operating the fan section 84 simultaneously with the generation of the gas flow by the gas flow generating unit 70.

The inkjet printing apparatus 10 of the present embodiment promotes drying of the preliminary processing fluid on the surfaces of the print medium 15 by generating the gas flow by the gas flow generating unit 70 and suctioning by the position determining members 80. The inkjet printing apparatus 10 further promotes drying of the print medium 15 by smoothly exhausting gas which evaporates from the back side (lower side) of the print medium 15.

In addition, the inkjet printing apparatus 10 of the present embodiment is capable of removing the moisture from the gas flow by passing the gas flow which is suctioned through the suction ports 81 of the position determining members 80 through the first filter 82, thereby further promoting drying. As another benefit of this feature, rusting of metal components can be prevented.

In addition, the inkjet printing apparatus 10 of the present embodiment is capable of removing unpleasant odors from the gas flow by passing the gas flow which is suctioned through the suction ports 81 of the position determining members 80 through the second filter 83. Thereby, it is possible to prevent the odors from spreading in the vicinity of the apparatus, and it is possible to improve the working environment for operators.

Then, when the drying unit 50 and the gas flow generating unit 70 move to a drying operation completion position (the front end in FIG. 15C), the control section 5 ceases the operations of the drying unit 50, the gas flow generating unit 70, and the fan section 84. Thereafter, the control section 5 controls the support member elevating mechanism 30 to move the lifting units 49 downward such that they are housed in the flat bed unit 3. As a result, the print medium 15 is placed directly on the medium placement surface 3*a* of the flat bed unit 3, as illustrated in FIG. 15D.

Also, the control section 5 controls the position determining member elevating mechanism 90 to move the position determining members 80 downward, such that the upper surfaces of the position determining members 80 are below the upper surface of print medium 15 and above the medium placement surface 3*a* of the flat bed unit 3. Then, positioning of the print medium 15 is performed by the user again. That is, the user causes one corner of the print medium 15 to abut the L shaped position determining members 80 and causes the two sides that form the corner to abut the rectangular parallelepiped position determining members 80. By positioning the print medium 15 in this manner, it is possible to ensure the positional accuracy of the image printed on the print medium 15.

Thereafter, the distance between the print medium 15 and the head unit 26 is adjusted. Specifically, the distance Z (refer to FIG. 15D) between the print medium 15, which is placed on the medium placement surface 3*a* of the flat bed unit 3, and the inkjet head 31 within the shuttle unit 4 is adjusted to be 1.5 mm±0.5 mm. The distance between the print medium 15 and the head unit 26 may be adjusted by moving the head unit 26 in the up-down direction, or by moving the flat bed unit 3 in the up-down direction.

Figure 15D:
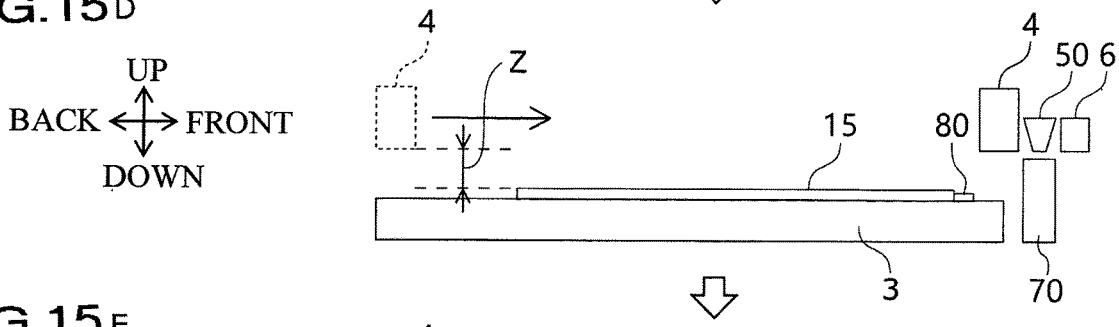
FIG. 15D is a collection of explanatory diagrams for explaining the operation of the inkjet printing apparatus of the second embodiment illustrated in FIG. 11

Next, the control section 5 controls the sub scanning drive motor 12 to perform a printing process while moving the shuttle unit 4 in the forward direction (the direction of the arrow illustrated in FIG. 15D), as illustrated in FIG. 15D. Specifically, the control section 5 moves the shuttle unit 4 to a printing start position above the print medium 15. By controlling the main scanning drive motor 23 to move the head unit 26 in the main scanning direction, the inkjet head 31 is controlled based on the input print job to eject ink from the nozzle 37, thereby performing printing for a single pass.

After printing for the single pass is completed, the control section 5 controls the sub scanning drive motor 12 to move the shuttle unit 4 forward to a printing position for a next pass. The control section 5 forms an image in print medium 15 by alternately repeating printing for single passes movement the of shuttle unit 4.

Figure 15E:
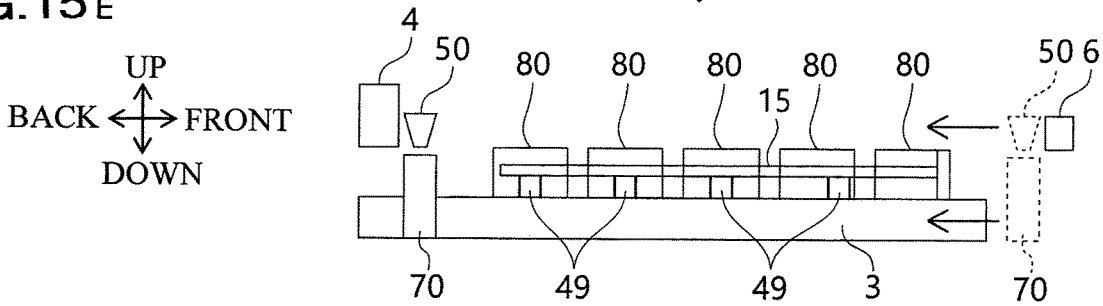
FIG. 15E is a collection of explanatory diagrams for explaining the operation of the inkjet printing apparatus of the second embodiment illustrated in FIG. 11

At a point in time when printing of one sheet is completed, the shuttle unit 4 is arranged at the initial position again, as illustrated in FIG. 15E. The control section 5 then controls the support member elevating mechanism 30 to move the lifting units 49 upward, and controls the position determining member elevating mechanism 90 to move the position determining members 80 upward. Thereby, the lifting units 49 and the position determining members 80 are caused to protrude from the flat bed unit 3 again.

Next, the control section 5 controls the sub scanning drive motor 12 to move the drying unit 50 and the gas flow generating unit 70 in the backward direction (the direction of the arrow illustrated in FIG. 15E), as illustrated in FIG. 15E.

At this time, the control section 5 sequentially heats the printing medium 15 along the forward direction by operating the drying unit 50 while moving the drying unit 50, to dry the ink which is attached to the print medium 15. In addition, the control section 5 generates gas flows above and below print medium 15 by operating the gas flow generating unit 70 simultaneously with the drying operation of the drying unit 50. Further, the control section 5 causes the fan section 84 to operate simultaneously with the generation of the gas flows by the gas flow generating unit 70, to perform suction through the suction ports 81 of the position determining members 80.

The inkjet printing apparatus 10 of the present embodiment promotes the drying of ink on the surface of the print medium 15 by the generation of the gas flows by the gas flow generating unit 70 and the suctioning by the position determining members 80. In addition, drying of the print medium 15 is further promoted by smoothly exhausting gas which evaporates on the back side (underside) of the print medium 15.

In addition, the inkjet printing apparatus 10 of the present embodiment is configured to causes the gas flow, which is suctioned by the suction ports 81 of the position determining members 80, to pass through the first filter 82 and the second filter 83, so that moisture and odor are removed.

The control section 5 then stops the drying operation, the gas flow generating operation and the suction operation described above when the drying unit 50 and the gas flow generating unit 70 are arranged at the back end initial position illustrated in FIG. 15E. Next, the control section 5 arranges the preliminary processing unit 6 at the back end initial position illustrated in FIG. 15A, and the series of processes is completed.

In the description above, a post process is performed. However, a post process may be performed after printing, depending on the type of the print medium 15 or the type of ink. In this case, the print medium 15 is coated with a post processing liquid after printing, and it is preferable for the drying operation, the gas flow generating operation, and the suctioning operation described above to be performed in a state in which the lifting units 49 and the position determining members 80 are protruding from the flat bed unit 3.

In the inkjet printing apparatus 10 of the second embodiment, the six rectangular parallelepiped position determining members 80 are moved in the up-down direction. However, the position determining members 80 to be moved in the up-down direction may be selected according to the size of the print medium 15. For example, in the case that a comparatively large print medium 15 is employed, all six of the rectangular parallelepiped position determining members 80 are moved in the up-down direction, as in the second embodiment described above. In the case that a comparatively small print medium 15 is used, only the two position determining members 80 which are closer to the L shaped position determining members 80 from among the four rectangular parallelepiped position determining members 80, for example, may be moved in the up-down direction. That is, in the case that the size of the print medium 15 is comparatively small, only the rectangular parallelepiped position determination members 80 close to the L shaped position determining members 80 from among the six rectangular parallelepiped position determining members 80 may be moved in the up-down direction.

Specifically, a table or the like in which the sizes of print media 15 and the position determining members 80 to be moved in the up-down direction are correlated with each other may be set in the control section 5 in advance. In this case, the control section 5 may refer to the table based on input information regarding the size of a print medium 15, and control the position determining member elevating mechanism 90 to select the position determining members 80 to be moved in the up-down direction.

The information regarding the size of the print medium 15 may be input and set by a user, or may be information included in a print job which is obtained. Alternatively, the size of a print medium 15 which is placed on the flatbed unit 3 may be detected by employing an optical sensor or the like.

Note that the position determining members 80 may be divided into blocks as the position determining members 80 of the second embodiment described above are, or may be of an integrated unitary shape.

In addition, in the case that the inkjet printing apparatuses 1 and 10 of the first and second embodiments are configured such that the gas flow generating units 60, 70 are capable of generating warm gas flow, warm gas flow and cold gas flow may be switched according to the amount or the type of preliminary processing fluid or the total amount of ejected ink. That is the, control section 5 may switch to cold air when the amount of preliminary processing fluid or total amount of ejected ink is small, and switch to warm air when these amounts are large. Alternatively, in the case that a preliminary processing fluid or ink which is likely to volatilize is employed, the control section 5 may switch to cold gas flow, and in the case that a preliminary processing fluid or ink which is not likely to volatilize is employed, the control section 5 may switch to warm gas flow. By switching between cold gas flow and warm gas flow in this manner, electrical power consumption can be reduced. Note that the method for obtaining information regarding the amount or the type of preliminary processing fluid, the total amount of ejected ink, or the type of ink is the same as that which was described previously.

The following additional items are disclosed with respect to the inkjet printing apparatus of the present invention.

The inkjet printing apparatus of the present invention may be provided with a support member on the table that forms a space between the surface of the print medium toward the table and the table.

In addition, in the inkjet printing apparatus of the present invention, the support member may be of a columnar shape that extends in the vertical direction or a rectangular parallelepiped shape that extends in the horizontal direction.

In addition, in the inkjet printing apparatus of the present invention, the support member may be columnar, and a plurality of columnar support members may be provided along a direction perpendicular to the direction of the gas flow which is generated by the gas flow generating unit with intervals therebetween such that the gas flow can pass therethrough.

In addition, the inkjet printing apparatus of the present invention may be equipped with an elevating mechanism for raising and lowering the support member in the vertical direction.

In addition, the inkjet printing apparatus of the present invention may be equipped with a support member elevating mechanism for raising and lowering the support member in the vertical direction. The support member elevating mechanism may raise the support member upward in the vertical direction during the gas flow generating operation of the gas flow generating unit to form the space, and lower the support member downward in the vertical direction during a printing operation.

In addition, in the inkjet printing apparatus of the present invention, it is possible to provide an adjusting mechanism for adjusting the position of at least one of the print medium and the drying unit according to the thickness of print medium.

In addition, in the inkjet printing apparatus of the present invention, the gas flow generating unit may be capable of generating gas flow by suctioning gas from within in the space.

In addition, the inkjet printing apparatus of the present invention may be provided with a control section that exerts control such that a drying operation by the drying unit and a gas flow generating operation by the gas flow generating unit are simultaneously performed.

In addition, the inkjet printing apparatus of the present invention may be provided with a control section for controlling at least one of the drying unit and the gas flow generating unit according to the type of the print medium.

In addition, the inkjet printing apparatus of the present invention may be provided with a position determining member that positions the print medium within a placement surface for the print medium. The position determining member may have a suctioning mechanism for suctioning the gas flow which is generated by the gas flow generating unit.

In addition, the inkjet printing apparatus of the present invention may be provided with a position determining member elevating mechanism for raising and lowering the position determining member. The position determining member elevating mechanism may move the position determining member upward in the vertical direction during a gas flow generating operation by the gas flow generating unit, and move the position determining member downward in the vertical direction during a printing operation.

In addition, the inkjet printing apparatus of the present invention may be provided with a filter, through which gas flow which is suctioned by the suctioning mechanism of the position determining member passes, that removes moisture or odor included in the gas flow.

In addition, the inkjet printing apparatus of the present invention may be provided with a switching section that switches between internal circulation and exhaust to the exterior of the gas flow which has passed through the filter, according to the amount or the type of liquid that the print medium is coated with.

In addition, the inkjet printing apparatus of the present invention may employ a filter that removes moisture which is included in the gas flow as the filter, and may be equipped with a switching section that switches between internal circulation and exhaust to the exterior of the gas flow which has passed through the filter, according to the amount of moisture which is included in the gas flow.

EXPLANATION OF THE REFERENCE NUMERALS

1 ink jet printing apparatus
2 shuttle base unit
3 flatbed unit
3*a* medium mounting surface
3*b* passage aperture
3*c* suctioning aperture
3*d* first passage aperture
3*e* second passage aperture
4 shuttle unit
5 control unit
10 ink jet printing apparatus
11 gantry section
12 sub scanning drive motor
13A, 13B, 13C sub scanning drive guide
15 printing medium
21 casing
22 main scanning drive guide
23 main scanning drive motor
24 head elevating guide
25 head elevating motor
26 head unit
30 support member elevating mechanism
31 ink jet head
35 nozzle plate
35*a* ink ejection surface
36 nozzle guard
37 nozzle
38 opening
40 support member
41 lifting unit
42 space
43 flow straightening member
44 support member
45 protruding portion
46 recessed portion
47 suctioning pipe
48 suction pump
49 lifting unit
50 dry unit
60 gas flow generating unit
61 operation panel
70 gas flow generating unit
70*a* upper exhaust port
70*b* lower exhaust port
80 position determining member
81 suction port
82 first filter
83 second filter
84 fan section
85 intake pipe
86 vent pipe
87 exhaust pipe
88 circulation pipe
90 position determining member elevating mechanism

What is claimed is:

1. An inkjet printing apparatus that ejects ink from an inkjet head to a print medium to perform printing, comprising:

a drying unit for drying a liquid which is contained in the print medium;

a table on which the print medium is placed;

a plurality of spaced apart support members raising the print medium above the table, forming a plurality of spaces between the table and a surface of the print medium facing the table; and a gas flow generating unit for blowing gas into the plurality of spaces.

2. An inkjet printing apparatus as defined in claim 1, wherein:

the gas flow generating unit blows air from a front side to a back side of the table, in a sub scanning direction of the inkjet printing apparatus.

3. An inkjet printing apparatus as defined in claim 1, wherein: the table is provided with a support member that forms the space.

4. An inkjet printing apparatus as defined in claim 1, further comprising: an adjustment mechanism for adjusting the position of at least one of the print medium and the drying unit according to the thickness of the print medium.

5. An inkjet printing apparatus as defined in claim 1, further comprising: a control section that controls at least one of the drying unit and the gas flow generating unit according to the type of the print medium.

6. An inkjet printing apparatus as defined in claim 1, further comprising:

a position determining member that positions the print medium within a placement surface for the print medium, and wherein:

the position determining member comprises a suctioning mechanism for suctioning the gas flow which is generated by the gas flow generating unit.

7. An inkjet printing apparatus as defined in claim 6, further comprising:

a position determining member elevating mechanism for raising and lowering the position determining member, and wherein:

the position determining member elevating mechanism moves the position determining member upward in the vertical direction during a gas flow generating operation by the gas flow generating unit, and moves the position determining member downward in the vertical direction during a printing operation.

8. An inkjet printing apparatus as defined in claim 6, further comprising:

a filter, through which gas flow which is suctioned by the suctioning mechanism of the position determining member passes, that removes moisture or odor included in the gas flow.

9. An ink jet printing apparatus as defined in claim 8, further comprising:

a switching section that switches between internal circulation and exhaust to the exterior of the gas flow which has passed through the filter, according to the amount or the type of liquid that the print medium is coated with.

10. An ink jet printing apparatus as defined in claim 8, wherein:

the filter is included in the gas flow and removes moisture included in the gas flow; and the inkjet printing apparatus further comprises a switching section that switches between internal circulation and exhaust to the exterior of the gas flow which has passed through the filter, according to the amount of moisture which is included in the gas flow.

11. An inkjet printing apparatus that ejects ink from an inkjet head to a print medium to perform printing, comprising:

a drying unit for drying a liquid which is contained in the print medium;

a table on which the print medium is placed;

a gas flow generating unit for generating a gas flow in a space which is formed between the table and a surface of the print medium facing a side of the table; and a support member provided on the table to form the space;

the support member being columnar, and a plurality of the columnar support members being provided along a direction perpendicular to the direction of the gas flow which is generated by the gas flow generating unit with intervals therebetween such that the gas flow can pass therethrough.

12. An inkjet printing apparatus that ejects ink from an inkjet head to a print medium to perform printing, comprising:

a drying unit for drying a liquid which is contained in the print medium;

a table on which the print medium is placed;

a gas flow generating unit for generating a gas flow in a space which is formed between the table and a surface of the print medium facing a side of the table;

a support member provided on the table to form the space; and an elevating mechanism for raising and lowering the support member; and wherein:

the support member elevating mechanism raises the support member upward in the vertical direction during a gas flow generating operation of the gas flow generating unit to form the space, and lowers the support member downward in the vertical direction during a printing operation.

* * * * *